US011982004B2

(12) United States Patent
Vaders et al.

(10) Patent No.: US 11,982,004 B2
(45) Date of Patent: May 14, 2024

(54) METHOD FOR REMOVING METAL STAINS FROM A METAL SURFACE

(71) Applicant: Coöperatie Koninklijke Cosun U.A., Breda (NL)

(72) Inventors: Johanna Elisabet Nelke Vaders, Houten (NL); Robert Lazeroms, Sprundel (NL)

(73) Assignee: Coöperatie Koninklijke Cosun U.A., Breda (NL)

( * ) Notice: Subject to any disclaimer, the term of this patent is extended or adjusted under 35 U.S.C. 154(b) by 0 days.

(21) Appl. No.: 17/800,239

(22) PCT Filed: Feb. 24, 2021

(86) PCT No.: PCT/EP2021/054529
§ 371 (c)(1),
(2) Date: Aug. 17, 2022

(87) PCT Pub. No.: WO2021/170635
PCT Pub. Date: Sep. 2, 2021

(65) Prior Publication Data

US 2023/0085240 A1 Mar. 16, 2023

(30) Foreign Application Priority Data

Feb. 25, 2020 (EP) ..... 20159272

(51) Int. Cl.
*C23G 1/22* (2006.01)

(52) U.S. Cl.
CPC ..... *C23G 1/22* (2013.01)

(58) Field of Classification Search
CPC ..... C23G 1/22
See application file for complete search history.

(56) References Cited

U.S. PATENT DOCUMENTS 3,853,618 A * 12/1974 Smith ..... C23G 1/36 134/13
6,057,240 A * 5/2000 Zhou ..... H01L 21/32136 438/735

(Continued)

FOREIGN PATENT DOCUMENTS

EP 3617346 A1 3/2020
WO 2010104816 A1 9/2010
WO WO-2010104816 A1 * 9/2010 ..... C11D 11/0047

*Primary Examiner* — Duy Vu N Deo
*Assistant Examiner* — Christopher Remavege
(74) *Attorney, Agent, or Firm* — N.V. Nederlandsch Octrooibureau

(57) ABSTRACT

The invention relates to a method for removing and/or decolourizing metal stains on a surface of a substrate composed of aluminium or aluminium alloy, the method comprising the consecutive steps of (a) providing the substrate comprising metal stains on the surface, said metal stains having a metal stain surface area; (b) providing an aqueous treatment liquid comprising one or more components selected from the group consisting of galactaric acid and galactarate salts; and (c) treating at least part of the surface of the substrate by contacting at least part of the metal stain surface area with the aqueous treatment liquid, wherein the aqueous treatment liquid is free of phosphorus- and/or acrylate-containing compounds and wherein the pH of the aqueous treatment liquid is between 6.5 and 10.9. The invention further concerns the resulting products and the use of the aqueous treatment liquid for removing and/or decolourizing metal stains on a surface of a substrate composed of aluminium or aluminium alloy.

15 Claims, 12 Drawing Sheets

(56) References Cited

U.S. PATENT DOCUMENTS

| | | | | |
|---|---|---|---|---|
| 9,404,188 | B2 * | 8/2016 | Smith | C23F 11/08 |
| 10,683,576 | B2 * | 6/2020 | Felipe | C23F 11/124 |
| 11,560,529 | B2 * | 1/2023 | Protzko | C11D 7/268 |
| 2003/0109394 | A1 * | 6/2003 | Ruhr | C11D 3/3757<br>510/202 |
| 2003/0176305 | A1 * | 9/2003 | Hoyt | C23G 1/20<br>510/252 |
| 2012/0048295 | A1 * | 3/2012 | Du | G03F 7/425<br>134/3 |
| 2012/0119152 | A1 * | 5/2012 | Smith | C23F 11/08<br>252/389.52 |
| 2015/0376799 | A1 * | 12/2015 | Felipe | C23F 11/126<br>210/698 |
| 2018/0274105 | A1 * | 9/2018 | Felipe | C23F 11/167 |

* cited by examiner

METHOD FOR REMOVING METAL STAINS FROM A METAL SURFACE

FIELD OF THE INVENTION

The present invention relates to a method for removing and/or decolourizing metal stains on a surface of a substrate composed of aluminium or an aluminium alloy. The invention further concerns the resulting products, the use of an aqueous treatment liquid for removing and/or decolourizing metal stains on a surface of a substrate composed of aluminium or aluminium alloy and the use of an aqueous treatment liquid for preventing the formation of metal stains and/or corrosion on a surface of a substrate composed of aluminium or an aluminium alloy. The invention also concerns a method for providing at least part of the surface of a substrate composed of aluminium or aluminium alloy with a white or whitish colour.

BACKGROUND OF THE INVENTION

Corrosion is the deterioration of materials, such as metals, by chemical interaction with their environment. Corrosion of metal objects occurs by electrochemical reactions at the metal surface, involving the oxidation of the metal in the presence of water, electrolytes and oxygen. Metals, except for the so-called noble metals, are most stable as oxides (under typical ambient conditions). Although aluminium is a very reactive metal with a high affinity for oxygen, the metal is highly resistant to most environments and to a great variety of chemical agents. This resistance is due to the inert and protective character of the aluminium oxide film which forms on the metal surface. However, when aluminium is exposed to alkaline conditions, corrosion may occur. Furthermore, when the oxide film is perforated locally, accelerated attack occurs because aluminium is attacked more rapidly than its oxide under alkaline conditions. Corrosion has negative effects on the safe, reliable and efficient operation of equipment or structures. Moreover, exposure to alkaline conditions results in deterioration of visual appearance due to staining of the aluminium surface.

Mechanical failure, deterioration of appearance, contamination of fluids in vessels and pipes, loss of surface properties, et cetera, can all be reasons to replace aluminium parts or products, even though the amount of metal destroyed may be quite small. However, replacement of corroded and/or stained aluminium parts or products can be expensive. Additionally, if the aluminium parts or products are still operational, it is environmentally undesirable to replace them. Similarly, replacing functional aluminium parts or products merely because the parts or products have an unattractive visual appearance can also be expensive and is also environmentally undesirable.

Instead of replacing the aluminium parts or products, one can try to clean them. The prior art proposes different techniques and formulations for cleaning corroded and/or stained surfaces of aluminium parts or products in order to attempt to restore the original look and lustre.

The corroded and/or stained surface of the aluminium products can for example be brushed, polished or abraded. A disadvantage of such techniques is that aluminium surfaces of complex geometries cannot be treated easily.

Aqueous solutions of white vinegar have been suggested for cleaning of stained aluminium pots, pans, kitchen utensils or surfaces. Compared to completely replacing the parts or products, using such formulations to restore the original look and lustre of the aluminium products is much less expensive.

US2014/0261564A1 describes the use of corrosion inhibiting consumer warewashing detergent compositions comprising an acrylic polymer, a phosphinosuccinic acid oligomer and an adjuvant in basic media for the cleaning of alkaline sensitive metals such as aluminium, tin and/or aluminium or tin containing alloys. The use of such a composition is however not desirable, because phosphorous- and/or acrylate-containing detergents have recently fallen out of favour due to environmental concerns.

Other approaches to remove or decolourize stained metal surfaces employ harsh acidic treatments. For example, US2013/0319467A1 is directed to acidic compositions, typically having a pH between 3 and 4, comprising an organic or inorganic acid and a reducing agent for the removal or decolourization of metal stains on metals composed of iron, manganese or copper. According to US2013/0319467A1, there are limitations to the convenience of acidic compositions employed as surface cleaners because metal surfaces of e.g. aluminium are sensitive to acids and may be severely damaged by acidic compositions used to clean said surfaces.

It is an object of the present invention to provide new methods for removing and/or decolourizing metal stains on a surface of a substrate composed of aluminium or an aluminium alloy, such as metal stains that result from subjecting said surface to alkaline components or from subjecting said surface to weathering conditions such as fluctuating temperature and humidity.

It is a further object of the present invention to provide methods for removing and/or decolourizing metal stains on a surface of a substrate composed of aluminium or an aluminium alloy that are industrially applicable.

It is another object of the invention to provide methods for removing and/or decolourizing metal stains on a surface of a substrate composed of aluminium or an aluminium alloy, that have, as compared to the methods known in the art, improved performance, reduced environmental impact and/or reduced toxicity.

SUMMARY OF THE INVENTION

The present inventors have surprisingly discovered that the treatment of stains on an aluminium or aluminium alloy surface, such as metal stains that result from subjecting said surface to alkaline components or from subjecting said surface to weathering conditions such as fluctuating temperature and humidity, with a galactaric acid compound, e.g. with an aqueous solution of galactaric acid, one or more galactarate salts, or combinations thereof, having a pH of between 6.5 and 10.9, in sufficiently high concentration, results in the removal and/or decolourization of said metal stains in an efficient way.

Accordingly, in a first aspect, the invention provides a method for removing and/or decolourizing metal stains on a surface of a substrate composed of aluminium or aluminium alloy, the method comprising the consecutive steps of:

a) providing the substrate comprising metal stains on the surface, said metal stains having a metal stain surface area;
b) providing an aqueous treatment liquid comprising one or more components selected from the group consisting of galactaric acid and galactarate salts; and
c) treating at least part of the surface of the substrate by contacting at least part of the metal stain surface area with the aqueous treatment liquid, wherein the aqueous treatment liquid is free of phosphorus- and/or acrylate-containing compounds and wherein the pH of the aqueous treatment liquid is between 6.5 and 10.9.

A further aspect of the invention concerns the products obtainable by said method. Without wishing to be bound by any theory, the inventors believe that the products obtainable by said method can be discerned from the untreated products by the disappearance of the metal stains and by the formation of a protective layer of galactaric acid compound on the treated part of the surface.

A still further aspect of the invention concerns the use of an aqueous treatment liquid comprising one or more components selected from the group consisting of galactaric acid and galactarate salts for removing and/or decolourizing metal stains on a surface of a substrate composed of aluminium or aluminium alloy, wherein the aqueous treatment liquid is free of phosphorus- and/or acrylate-containing compounds and wherein the pH of the aqueous treatment liquid is between 6.5 and 10.9.

Yet another aspect of the invention concerns the use of an aqueous treatment liquid comprising one or more components selected from the group consisting of galactaric acid and galactarate salts for preventing the formation of metal stains and/or corrosion on a surface of a substrate composed of aluminium or an aluminium alloy, wherein the pH of the aqueous treatment liquid is between 6.5 and 10.9.

A still further aspect of the invention concerns a method for providing at least part of the surface of a substrate composed of aluminium or aluminium alloy with a white or whitish colour, the method comprising the consecutive steps of:

a) providing the substrate composed of aluminium or aluminium alloy;
b) providing an aqueous treatment liquid comprising one or more components selected from the group consisting of galactaric acid and galactarate salts; and
c) treating the at least part of the surface of the substrate by contacting the at least part of the surface with the aqueous treatment liquid, wherein the aqueous treatment liquid is free of phosphorus- and/or acrylate-containing compounds and wherein the pH of the aqueous treatment liquid is between 6.5 and 10.9.

Galactaric acid provides the advantage that it can be obtained from renewable sources on an industrial scale, as opposed to most of the cleaning compositions available to date. In fact, galactaric acid can be sourced from side streams obtained in conventional sugar beet processing.

The use of galactaric acid, one or more galactarate salts, or combinations thereof, for the removal of metal stains from a surface of a substrate composed of aluminium or an aluminium alloy has not been suggested in the art before.

DETAILED DESCRIPTION OF THE INVENTION

Figure 1A:
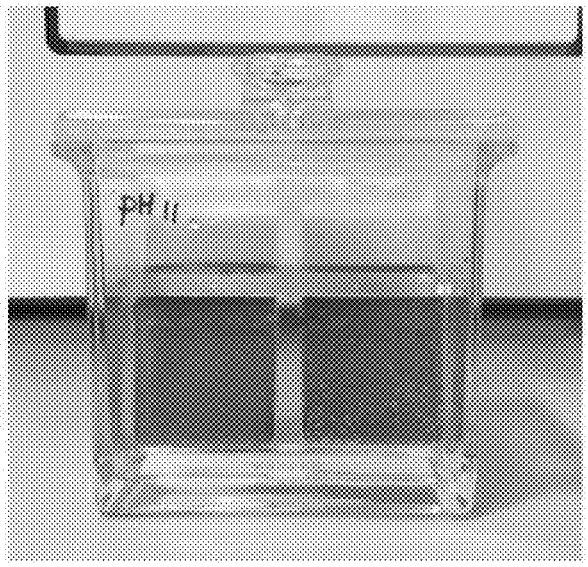
FIG. 1 depicts two partially stained aluminium coupons obtained after treatment of 2 hours with a NaOH solution in demineralized water at pH 11.

In a first aspect, the invention provides a method for removing and/or decolourizing metal stains on a surface of a substrate composed of aluminium or aluminium alloy, the method comprising the consecutive steps of:

a) providing the substrate comprising metal stains on the surface, said metal stains having a metal stain surface area;
b) providing an aqueous treatment liquid comprising one or more components selected from the group consisting of galactaric acid and galactarate salts; and
c) treating at least part of the surface of the substrate by contacting at least part of the metal stain surface area with the aqueous treatment liquid, wherein the aqueous treatment liquid is free of phosphorus- and/or acrylate-containing compounds and wherein the pH of the aqueous treatment liquid is between 6.5 and 10.9.

As used herein, the term 'free of phosphorus-containing compounds' refers to aqueous treatment liquids that do not contain a phosphorus-containing compound or to aqueous treatment liquids to which a phosphorus-containing compounds have not been added. Should a phosphorus-containing compound be present only through contamination, the amount of phosphorus-containing compounds shall be less than about 1 ppm, based on the total weight of the aqueous treatment liquid, preferably less than about 500 ppb, such as less than 100 ppb or less than 10 ppb. Non-limiting examples of phosphorus-containing compounds are phosphate-based detergents and phosphinosuccinic acid oligomers.

As used herein, the term 'free of acrylate-containing compounds' refers to aqueous treatment liquids that do not contain an acrylate-containing compound or to aqueous treatment liquids to which acrylate-containing compounds have not been added. Should an acrylate-containing compound be present through contamination, the amount of acrylate-containing compounds shall be less than about 1 ppm, based on the total weight of the aqueous treatment liquid, preferably less than about 500 ppb, such as less than 100 ppb or less than 10 ppb. Non-limiting examples of acrylate-containing compounds are acrylic acid, methacrylic acid, methacrylate and other acrylate monomers, acrylate and methacrylate polymers, and acrylate and methacrylate copolymers.

The terms 'destaining' 'decolourizing' and 'decolourization' as used herein refer to the reduction of the colour of metal stains towards the original colour of the aluminium or aluminium alloy substrate without metal stains.

The terms 'staining' and 'discolouration' as used herein refer to the formation of colour different from the colour of the original aluminium or aluminium alloy substrate.

In an embodiment, the substrate provided in step (a) is composed of, i.e. consists of, aluminium. As will be appreciated by those skilled in the art, the wording 'the substrate consists of aluminium' in the context of the present invention refers to the substrate before formation of the metal stains and before any (partial) oxidation of the outer layer, since the metal stains and any oxidized aluminium comprise or may comprise elements other than aluminium.

In an embodiment, the substrate provided in step (a) is composed of, i.e. consists of, an aluminium alloy comprising more than 70 wt. %, preferably more than 80 wt. %, more than 90 wt. %, more than 95 wt. % of aluminium. As will be appreciated by those skilled in the art, the wording 'the substrate consists of an aluminium alloy' in the context of the present invention refers to the substrate before formation of the metal stains and before any (partial) oxidation of the outer layer, since the metal stains and any oxidized aluminium alloy comprise or may comprise elements other than aluminium and the further alloy metals.

In an embodiment the aluminium alloy is selected from the group consisting of EN AW-1xxx alloy, EN AW-2xxx alloy, EN AW-3xxx alloy, EN AW-4xxx alloy, EN AW-5xxx alloy, EN AW-6xxx alloy, EN AW-7xxx alloy and EN AW-8xxx alloy, preferably selected from the group consisting of EN AW-1xxx alloy, EN AW-3xxx alloy, EN AW-4xxx alloy, EN AW-5xxx alloy and EN AW-6xxx alloy. It is appreciated by the skilled person that the International Alloy Designation System is the most widely accepted naming scheme for wrought alloys. Each alloy is given a four-digit number, wherein the first digit (Xxxx) indicates the principal alloying element, which has been added to the aluminium alloy and is used to describe the aluminium alloy series, i.e. 1000 series (99.000% minimum aluminium), 2000 series (copper), 3000 series (manganese), 4000 series (silicon), 5000 series (magnesium), 6000 series (magnesium and silicon), 7000 series (zinc) and 8000 series (other elements). The second single digit (xXxx), if different from 0, indicates a modification of the specific alloy, and the third and fourth digits (xxXX) are arbitrary numbers given to identify a specific alloy in the series. For example in alloy 5183, the number 5 indicates that it is of the magnesium alloy series, the 1 indicates that it is the 1st modification to the original alloy 5083, and the 83 identifies it in the 5xxx series. The only exception to this alloy numbering system is with the 1xxx series (pure aluminium) in which case, the last 2 digits provide the minimum aluminium percentage above 99%, i.e. alloy 1350 (99.50% minimum aluminium).

Non-limiting examples of aluminium (alloys) that can be treated with the method as defined herein are EN AW-1050A (99.5% Al), EN AW-2017 (94.2% Al, 4.0% Cu, 0.5% Si, 0.8% Mn, 0.5% Mg), EN AW-3003 (98.6% Al, 1.2% Mn, 0.12% Cu), EN AW-5005A (99.2% Al, 0.8% Mg), EN AW-6060 (98.9% Al, 0.4% Si, 0.5% Mg, 0.2% Fe), EN AW-7075 (90% Al, 5.6% Zn, 2.5% Mg, 1.6% Cu, 0.23% Cr). It is further appreciated by the skilled person that each aluminium alloy series has its characteristics and specific applications.

As is shown in the appended examples, the stain removal and/or decolourizing process according to the invention is faster when commercial aluminium test coupons are first treated with a sand paper than with untreated commercial aluminium test coupons that have been exposed to ambient conditions for some time. Without wishing to be bound by any theory, it is believed that this difference is due to (partial) oxidation of the aluminium or aluminium alloy outer layer. Treatment with sand paper removes the (partially) oxidized outer layer. Nevertheless, the process according to the invention is applicable to aluminium or aluminium alloy substrates having (partially) oxidized outer layers. For (partially) oxidized outer layers, the required contact time to obtain sufficient removal and/or decolouration of metal stains is typically longer than for metal stains on non-oxidized aluminium or aluminium alloy substrates.

Accordingly, in a preferred embodiment, the substrate composed of aluminium or aluminium alloy, provided in step (a), comprising metal stains on its surface, comprises an oxidized or partially oxidized outer layer having a thickness of less than 15 μm, preferably less than 6 μm.

In a very preferred embodiment, the substrate composed of aluminium or aluminium alloy, provided in step (a), comprising metal stains on its surface, is not oxidized.

In a preferred embodiment, the metal stains on the surface of the substrate composed of aluminium or aluminium alloy are caused by an alkaline medium, typically an alkaline medium having a pH of 9 or higher. Worded differently, in a preferred embodiment, the metal stains on the surface of the substrate composed of aluminium or aluminium alloy are alkaline-based metal stains. A non-limiting example of an alkaline medium that results in metal stains on a surface of a substrate composed of aluminium or aluminium alloy is an aqueous solution of NaOH at pH 11. In another embodiment, the metal stains on the surface of the substrate composed of aluminium or aluminium alloy are caused by weathering conditions such as fluctuating temperature and humidity.

It is appreciated by the skilled person that treating at least part of the surface of the substrate by contacting at least part of the metal stain surface area with the aqueous treatment liquid comprising one or more components selected from the group consisting of galactaric acid and galactarate salts at a pH higher than 7 is not considered alkaline treatment resulting in metal stains. As shown in the appended examples, the presence of the one or more components selected from the group consisting of galactaric acid and galactarate salts in the optionally alkaline aqueous treatment liquids according to the invention results in removal and/or decolourizing of metal stains on the surface of the substrate composed of aluminium or aluminium alloy, as opposed to the formation or development of metal stains on the surface of the substrate.

In an embodiment, the method as defined herein further comprises a step (d) of subjecting at least the treated part of the surface of the substrate obtained in step (c) to a drying operation.

In an embodiment, the method as defined herein is provided, wherein step (c) comprises immersing the at least part of the metal stain surface area in the aqueous treatment liquid.

In a preferred embodiment, the method as defined herein is provided, wherein step (c) comprises contacting the whole metal stain surface area with the aqueous treatment liquid.

In another preferred embodiment, the method as defined herein is provided, wherein step (c) comprises contacting the whole surface of the substrate with the aqueous treatment liquid.

In an embodiment, the aqueous treatment liquid comprises more than 100 ppm, based on the total weight of the aqueous treatment liquid, of the one or more components selected from the group consisting of galactaric acid and galactarate salts, preferably more than 500 ppm, more than 1000 ppm, more than 1500 ppm, more than 2000 ppm, more than 3000 ppm, more than 5000 ppm, or more than 8000 ppm.

In an embodiment, the aqueous treatment liquid comprises less than 25000 ppm, based on the total weight of the aqueous treatment liquid, of the one or more components selected from the group consisting of galactaric acid and galactarate salts, preferably less than 20000 ppm, less than 15000 ppm, less than 12000 ppm, or less than 10000 ppm.

In an embodiment, the aqueous treatment liquid comprises 500-25000 ppm, based on the total weight of the aqueous treatment liquid, of the one or more components selected from the group consisting of galactaric acid and galactarate salts, preferably 1000-20000 ppm, 2000-15000 ppm, 5000-12000 ppm, or 8000-10000 ppm.

In another embodiment, the aqueous treatment liquid comprises 500-20000 ppm, based on the total weight of the aqueous treatment liquid, of the one or more components selected from the group consisting of galactaric acid and galactarate salts, such as 500-15000 ppm, 500-12000 ppm, 500-10000 ppm, 500-8000 ppm, 500-5000 ppm, or 500-3000 ppm.

In still another embodiment, the aqueous treatment liquid comprises 1000-25000 ppm, based on the total weight of the aqueous treatment liquid, of the one or more components selected from the group consisting of galactaric acid and galactarate salts, such as 1500-25000 ppm, 2000-25000 ppm, 3000-25000 ppm, or 5000-25000 ppm.

As defined hereinbefore, the aqueous treatment liquid comprises one or more components selected from the group consisting of galactaric acid and galactarate salts. In an embodiment, the aqueous treatment liquid only comprises galactaric acid chosen from the group consisting of galactaric acid and galactarate salts and does not comprise galactaric acid salts. In a preferred embodiment, the aqueous treatment liquid comprises one or more galactarate salts and does not comprise galactaric acid.

In a preferred embodiment, the galactarate salts are selected from the group consisting of ammonium galactarate, mono ethanolammonium galactarate, di-ethanolammonium galactarate, tri-ethanolammonium galactarate, mono isopropanolammonium galactarate, sodium galactarate, potassium galactarate, and combinations thereof.

In a very preferred embodiment the aqueous treatment liquid comprises one or more components selected from the group consisting of sodium galactarate, potassium galactarate, ammonium galactarate, and combinations thereof, even more preferably one or two components selected from the group consisting sodium galactarate and ammonium galactarate, most preferably sodium galactarate.

In another very preferred embodiment the aqueous treatment liquid comprises one or more components selected from the group consisting of sodium galactarate, potassium galactarate, ammonium galactarate, and combinations thereof, even more preferably one or two components selected from the group consisting sodium galactarate and ammonium galactarate, most preferably sodium galactarate, wherein the aqueous treatment liquid does not comprise galactaric acid.

In still another very preferred embodiment the aqueous treatment liquid comprises one component selected from the group consisting of sodium galactarate, potassium galactarate and ammonium galactarate, even more preferably one component selected from the group consisting sodium galactarate and ammonium galactarate.

In yet another very preferred embodiment the aqueous treatment liquid comprises one component selected from the group consisting of sodium galactarate, potassium galactarate and ammonium galactarate, even more preferably one component selected from the group consisting sodium galactarate and ammonium galactarate, wherein the aqueous treatment liquid does not comprise galactaric acid.

It will be appreciated by the skilled person that reference is made to galactarate salts in existence at the time just before first contacted, blended, or mixed with water, upon which the salts may dissociate into ions or undergo a chemical reaction or other transformation, and coordinated solvents, such as water of crystallization, will dissolve.

In preferred embodiments, the method of the present invention is provided, wherein the aqueous treatment liquid comprises no other acidic components and their salts and/or other alkaline components than said one or more components selected from the group consisting of galactaric acid and galactarate salts as defined herein. Non-limiting examples of other acidic components and their salts are lactic acid, citric acid, propionic acid, acetic acid, hydroxyacetic acid, formic acid, glutaric acid, malic acid, hydroxy propionic acid, succinic acid, glutaric acid, adipic acid, fumaric acid, urea hydrochloride, hydrochloric acid, nitric acid, sulfuric acid, sulfamic acid, urea dihydrogen sulfate, phosphoric acid, their salts and mixtures thereof. Non-limiting examples of other alkaline components are alkali metal hydroxides, such as sodium hydroxide, potassium hydroxide, and lithium hydroxide, alkali metal oxides such as sodium oxide, potassium oxide and lithium oxide, alkali metal salts such as sodium carbonate, trisodium phosphate, potassium carbonate, silicates such as sodium metasilicates, sesquisilicates, orthosilicates, potassium silicates, phosphates such as sodium pyrophosphate, potassium pyrophosphate, amines such as alkanolamine (e.g. triethanolamine, monoethanolamine, diethanolamine), and mixtures thereof.

In highly preferred embodiments, the aqueous treatment liquid consists of water and the one or more components selected from the group consisting of galactaric acid and galactarate salts.

In an embodiment, the pH of the aqueous treatment liquid is between 7 and 10.7, preferably between 7.5 and 10.6.

In an embodiment, step (c) is performed at room temperature, preferably at a temperature between 10 and 30° C., more preferably at a temperature between 15 and 25° C.

In an embodiment, the time period of contacting the substrate and the aqueous treatment liquid in step (c) is long enough to remove all metal stains from the surface.

Typically, the time period of contacting the substrate and the aqueous treatment liquid in step (c) varies between a couple of hours and a couple of days, such as between 30 minutes and 6 days, or between 2 hours and 3 days or between 3 hours and 1 day.

It will be appreciated by the skilled person that the time needed to remove all metal stains from the surface is correlated to the size and/or the thickness of the metal stain surface area. A larger metal stain surface area and/or thicker metal stains will require a longer time period of contacting the substrate and the aqueous treatment liquid in step (c). Moreover, metal stains on (partially) oxidized surfaces may require a longer contact time to obtain sufficient removal and/or decolouration than metal stains on non-oxidized aluminium or aluminium alloy substrates.

As shown in the appended examples, the inventors have found that at higher concentrations of the one or more components selected from the group consisting of galactaric acid and galactarate salts in the aqueous treatment liquid, the time period of contacting the substrate and the aqueous treatment liquid in step (c) needed to obtain complete removal of stains/discolouration is reduced.

In a preferred embodiment, the aqueous treatment liquid is stirred during contacting the at least part of the metal stain surface area with the aqueous treatment liquid. In a more preferred embodiment, the stirring of the aqueous treatment liquid occurs at a stirring speed between 100 and 400 rpm, preferably, between 250 and 300 rpm, for example with a magnetic stirrer.

In an embodiment, the aqueous treatment liquid comprises sodium galactarate and the concentration of sodium galactarate in the aqueous treatment liquid is:

(i) between 1000 and 3000 ppm, such as about 2000 ppm, based on the total weight of the aqueous treatment liquid, wherein the time period of contacting the at least part of the metal stain surface area with the aqueous treatment liquid in step (c) is between 2 hours and 6 days, preferably between 2 hours and 2 days, more preferably between 2 hours and 1 day, even more preferably between 2 hours and 4 hours;

(ii) between 4000 and 6000 ppm, such as about 5000 ppm, based on the total weight of the aqueous treatment liquid, wherein the time period of contacting the at least part of the metal stain surface area with the aqueous treatment liquid in step (c) is between 1 hour and 6 days, preferably between 1 hour and 2 days, more preferably between 1 hour and 1 day, even more preferably between 1 hour and 2 hours;

(iii) between 6000 and 10000 ppm, such as about 8000 ppm based on the total weight of the aqueous treatment liquid, wherein the time period of contacting the at least part of the metal stain surface area with the aqueous treatment liquid in step (c) is between 40 minutes and 6 days, preferably between 40 minutes and 2 days, more preferably between 40 minutes and 1 day, even more preferably between 40 minutes and 80 minutes; or (iv) between 8000 and 12000 ppm, such as about 10000 ppm, based on the total weight of the aqueous treatment liquid, wherein the time period of contacting the at least part of the metal stain surface area with the aqueous treatment liquid in step (c) is between 30 minutes and 6 days, preferably between 30 minutes and 2 days, more preferably between 30 minutes and 1 day, even more preferably between 30 minutes and 50 minutes.

In an embodiment, the aqueous treatment liquid comprises ammonium galactarate and the concentration of ammonium galactarate in the aqueous treatment liquid is between 5000 and 25000 ppm, such as about 10000 ppm or about 20000 ppm, based on the total weight of the aqueous treatment liquid, wherein the time period of contacting the at least part of the metal stain surface area with the aqueous treatment liquid in step (c) is between 1 and 6 days.

In an embodiment, the aqueous treatment liquid provided in step (b) further comprises a degreaser.

In preferred embodiments, the aqueous treatment liquid is selected from the group consisting of aqueous anodising liquids, aqueous metal-rolling liquids, aqueous aluminium cleaning liquids, aqueous lubricant liquids and aqueous pickling liquids. As will be appreciated by the skilled person, these specific types of liquids comprise, in addition to the one or more components selected from the group consisting of galactaric acid and galactarate salts, further ingredients dependent on the specific application.

In a further aspect, the present invention provides the products obtainable by the method described herein.

Without wishing to be bound by any theory, the inventors believe that the products obtainable by said method can be discerned from the untreated products by the disappearance of the metal stains and by the formation of a protective layer of galactaric acid and/or galactarate salts on the treated part of the surface.

A further aspect of the invention concerns the use of an aqueous treatment liquid comprising one or more components selected from the group consisting of galactaric acid and galactarate salts for removing and/or decolourizing metal stains on a surface of a substrate composed of aluminium or aluminium alloy, wherein the aqueous treatment liquid is free of phosphorus- and/or acrylate-containing compounds and wherein the pH of the aqueous treatment liquid is between 6.5 and 10.9.

Another aspect of the invention concerns the use of an aqueous treatment liquid comprising one or more components selected from the group consisting of galactaric acid and galactarate salts for preventing the formation of metal stains and/or corrosion on a surface of a substrate composed of aluminium or an aluminium alloy, wherein the aqueous treatment liquid is free of phosphorus- and/or acrylate-containing compounds and wherein the pH of the aqueous treatment liquid is between 6.5 and 10.9.

Worded differently, another aspect of the invention concerns the use of an aqueous treatment liquid comprising one or more components selected from the group consisting of galactaric acid and galactarate salts as an inhibitor of metal stain and/or corrosion formation on a surface of a substrate composed of aluminium or an aluminium alloy, wherein the aqueous treatment liquid is free of phosphorus- and/or acrylate-containing compounds and wherein the pH of the aqueous treatment liquid is between 6.5 and 10.9

Without wishing to be bound by any theory, the inventors believe that contacting the surface of a substrate composed of aluminium or an aluminium alloy with the aqueous treatment liquid, typically for a time period between 1 hour up to a couple of days, optionally followed by drying of the surface, deposits a film layer on the substrate, wherein this film layer comprises the one or more components selected from the group consisting of galactaric acid and galactarate salts. The present inventors believe that this film layer prevents or reduces the formation of metal stains caused by an alkaline medium or due to weathering conditions such as fluctuating temperature and humidity. As shown in the appended examples, alkaline treatment of aluminium/aluminium alloy coupons with NaOH at pH=11, resulting in severe staining of the aluminium surface, followed by decolourization using the method according to the invention resulted in an aluminium substrate that was more resistant to discolourization/staining in a subsequent alkaline treatment step with NaOH at pH=11. Moreover, treatment of clean aluminium/aluminium alloy coupons (no stains) with the aqueous treatment liquid resulted in an aluminium substrate that was more resistant to discolourization/staining in a subsequent alkaline treatment step with NaOH at pH=11. In addition, alkaline treatment of aluminium/aluminium alloy coupons with NaOH at pH=11, resulting in severe staining of the aluminium surface, followed by decolourization using the method according to the invention resulted in an aluminium substrate that appears to have a self-healing protective film layer comprising the one or more components selected from the group consisting of galactaric acid and galactarate salts. Without wishing to be bound by any theory, the inventors believe that this self-healing effect is due to the chemical structure of galactaric acid having multiple sites for hydrogen bonding. Thus, scratches (made) in the aluminium top layer are still protected against the risk of staining and/or corrosion. Besides the direct protection, self-healing is also beneficial for coating applications to protect metal surfaces in general from staining and/or corrosion. Within a coating (formulation), salts of galactaric acid can work as a protective layer or as a protective additive.

A still further aspect of the invention concerns a method for providing at least part of the surface of a substrate composed of aluminium or aluminium alloy with a white or whitish colour, the method comprising the consecutive steps of:

a) providing the substrate composed of aluminium or aluminium alloy;
b) providing an aqueous treatment liquid comprising one or more components selected from the group consisting of galactaric acid and galactarate salts; and
c) treating the at least part of the surface of the substrate by contacting the at least part of the surface with the aqueous treatment liquid, wherein the aqueous treatment liquid is free of phosphorus- and/or acrylate-containing compounds and wherein the pH of the aqueous treatment liquid is between 6.5 and 10.9.

In an embodiment, this method further comprises a step (d) of subjecting at least the treated part of the surface of the substrate obtained in step (c) to a drying operation.

The inventors want to emphasize that all embodiments related to the aqueous treatment liquid, the metal stains and the substrate, as defined in the context of the method of the present invention, also apply to the uses of the aqueous treatment liquid according to the invention.

Thus, the invention has been described by reference to certain embodiments discussed above. It will be recognized that these embodiments are susceptible to various modifications and alternative forms well known to those of skill in the art.

Furthermore, for a proper understanding of this document and its claims, it is to be understood that the verb 'to comprise' and its conjugations are used in its non-limiting sense to mean that items following the word are included, but items not specifically mentioned are not excluded. In addition, reference to an element by the indefinite article 'a' or 'an' does not exclude the possibility that more than one of the element is present, unless the context clearly requires that there be one and only one of the elements. The indefinite article 'a' or 'an' thus usually means 'at least one'.

Furthermore, the various embodiments, although referred to as 'preferred' are to be construed as exemplary manners in which the invention may be implemented rather than as limiting the scope of the invention.

The invention will be further illustrated by means of the following examples, which are not intended to limit the scope of the invention in any way.

EXAMPLES

Example 1

Figure 1B:
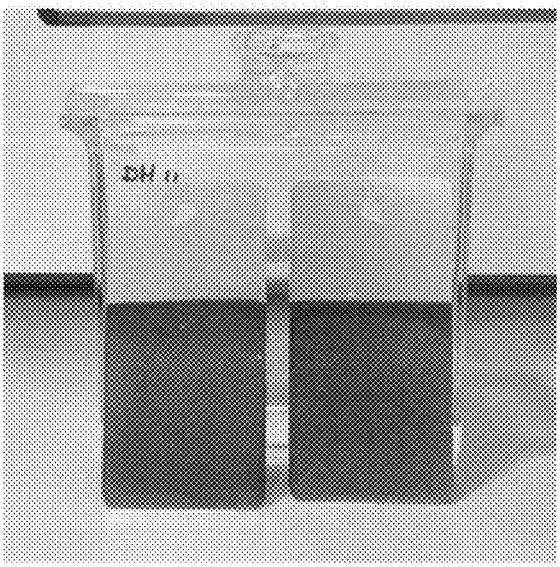

In order to test removal of aluminium staining, two identical aluminium coupons (Q-panel 3003 H14) were first stained by partially submerging them for 2 hours in a NaOH solution in demineralized water at pH 11. The treated parts of the aluminium coupons were completely stained and showed very dark discolouration. The results are also shown in FIG. 1*a* (treated coupons in the alkaline solution) and FIG. 1*b* (treated coupons removed from the alkaline solution). The results are also described in Table 1.

TABLE 1

| Solution | Result after 2 hours |
|---|---|
| NaOH solution in demineralized water at pH 11 | Complete staining, very dark discolouration |

Figure 2A:
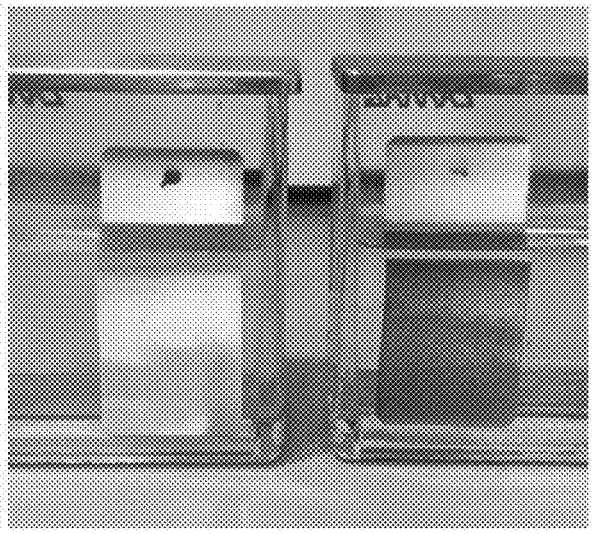
FIG. 2 depicts the removal of the staining on the coupons of FIG. 1 with an aqueous treatment liquid of 2000 ppm sodium galactarate at pH 10.3.
Figure 2B:
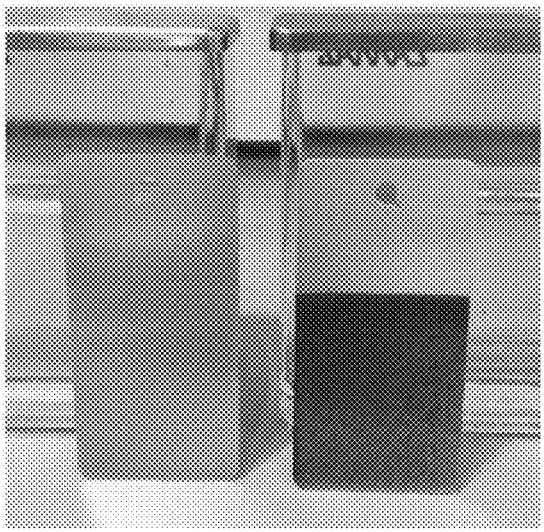

The two partially stained aluminium coupons were subsequently put in 2 different liquids: the first coupon in demineralized water and the second coupon in an aqueous treatment liquid comprising sodium galactarate (2000 ppm, based on the total weight of the aqueous treatment liquid, pH 10.3) in demineralized water. It was shown that the aluminium staining was completely removed after 3 hours residence time in the aqueous treatment liquid comprising sodium galactarate. The results are shown in FIG. 2. FIG. 2*a* depicts the second coupon after 3 hours in the aqueous treatment liquid comprising sodium galactarate (left-hand side) and the first coupon after 3 hours in demineralized water (right-hand side). FIG. 2*b* depicts the first and second coupon of FIG. 2*a* after removal from their respective liquids. The results are also described in Table 2

TABLE 2

| Solution | Result after 3 hours |
|---|---|
| Demineralized water | Very dark discolouration |
| 2000 ppm sodium galactarate in demineralized water at pH 10.3 | Complete removal of the aluminium staining |

Example 2

The removal of aluminium staining was evaluated at different concentrations of sodium gal actarate.

Two identical aluminium coupons (Q-panel 3003 H14) were stained by partially submerging them for 2 hours in a NaOH solution in demineralized water at pH 11. The treated parts of the aluminium coupons were completely stained and showed very dark discolouration.

The two stained aluminium coupons were subsequently put in 2 different aqueous treatment solutions: the first coupon in an aqueous treatment solution comprising 2000 ppm sodium galactarate, based on the total weight of the aqueous treatment liquid, in demineralized water at pH 10.3, and the second coupon in an aqueous treatment solution comprising 5000 ppm sodium galactarate, based on the total weight of the aqueous treatment liquid, in demineralized water at pH 10.6. The first aluminium coupon submerged in the aqueous treatment liquid with 2000 ppm sodium galactarate still showed full staining/discolouration after 45 minutes, whereas the second aluminium coupon submerged in the aqueous solution with 5000 ppm sodium galactarate already showed reduced staining/discolouration after 45 minutes. The first aluminium coupon submerged in the aqueous treatment liquid with 2000 ppm sodium galactarate still showed some aluminium stains and discolouration after 1.5 hours, whereas the second aluminium coupon submerged in the aqueous solution with 5000 ppm sodium galactarate showed no aluminium stains and no discolouration after 1.5 hours.

Figure 3:
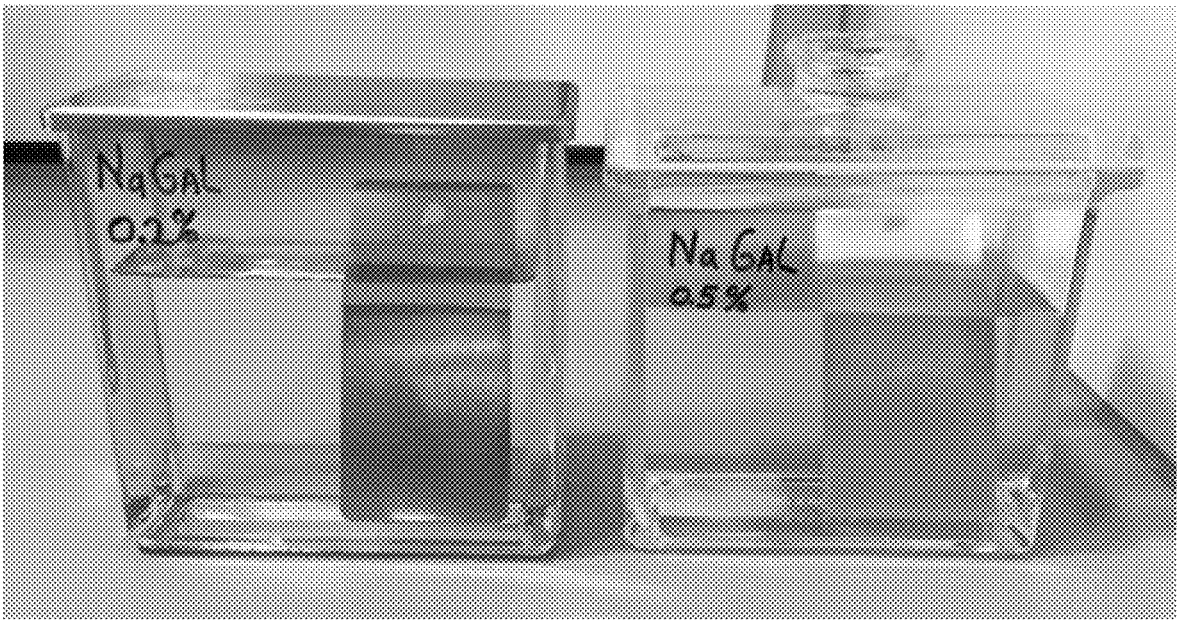
FIG. 3 depicts the removal of the staining on the coupons of FIG. 1 with an aqueous treatment liquid of 2000 ppm sodium galactarate at pH 10.3 and an aqueous solution of 5000 ppm sodium galactarate at pH 10.6 after 45 minutes.
Figure 4:
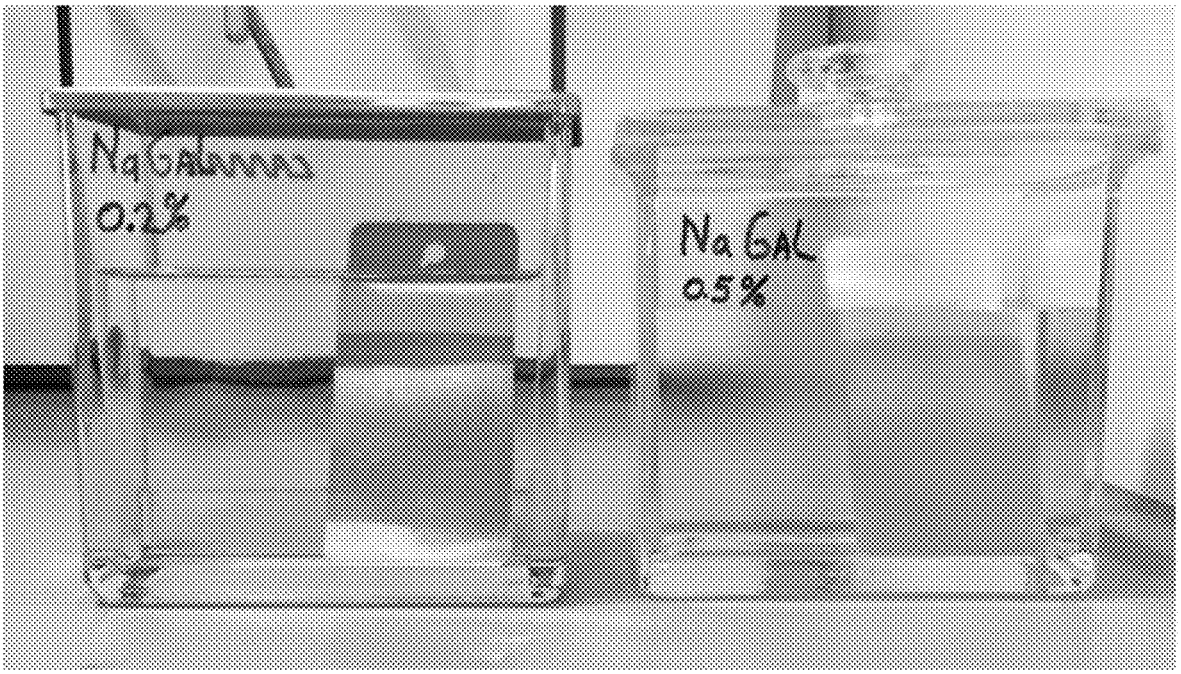
FIG. 4 depicts the removal of the staining on the coupons of FIG. 1 with an aqueous treatment liquid of 2000 ppm sodium galactarate at pH 10.3 and an aqueous solution of 5000 ppm sodium galactarate at pH 10.6 after 1.5 hours.

Hence, the removal of aluminium staining/discolouration can be accelerated by applying a higher concentration of sodium galactarate. The result are also shown in FIG. 3 (result after 45 minutes, left-hand side, 2000 ppm, right-hand side 5000 ppm) and in FIG. 4 (result after 1.5 hours, left-hand side, 2000 ppm, right-hand side 5000 ppm).

TABLE 3

| Solution | Results after 45 min | Results after 1.5 h |
|---|---|---|
| 2000 ppm sodium galactarate, pH 10.3 | dark discolouration | some staining/ discolouration |
| 5000 ppm sodium galactarate, pH 10.6 | some staining/ discolouration | complete removal of the aluminium staining |

Example 3a

Figure 5A:
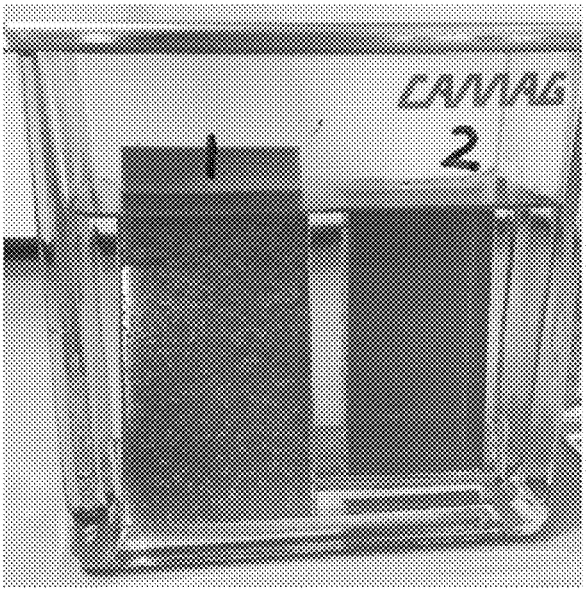
FIGS. 5-8 depict the staining of different aluminium/aluminium alloy coupons with a NaOH solution in demineralized water at pH 11 and the subsequent removal of the staining with an aqueous treatment liquid of 5000 ppm sodium galactarate at pH 10.6.
Figure 5B:
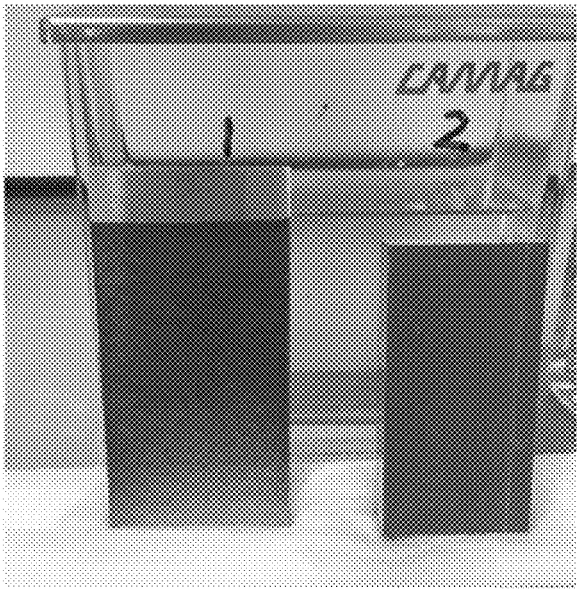
Figure 6A:
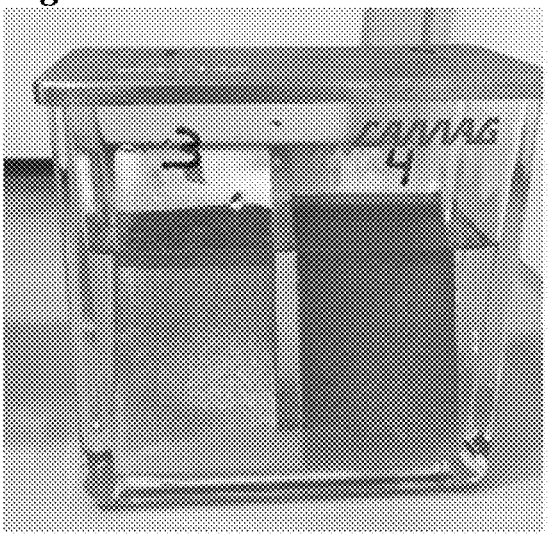
Figure 6B:
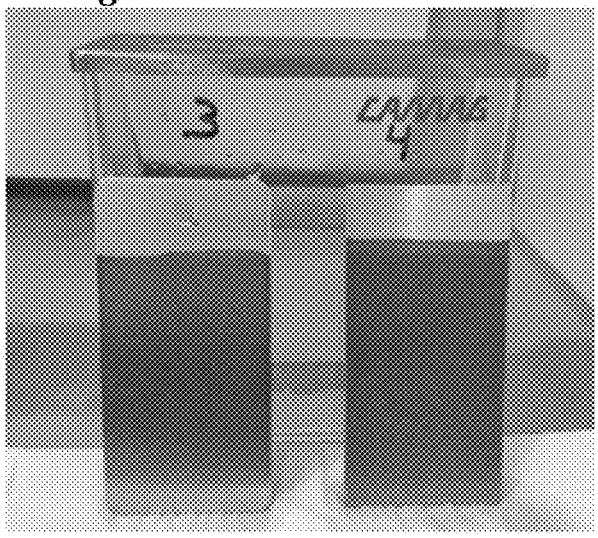
Figure 7A:
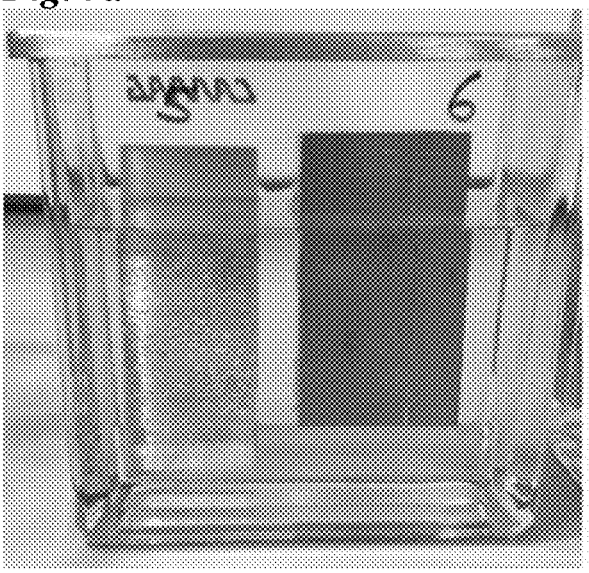
Figure 7B:
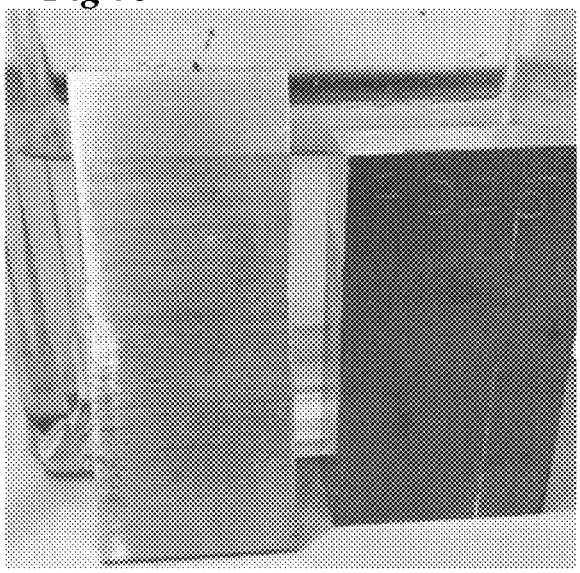
Figure 8A:
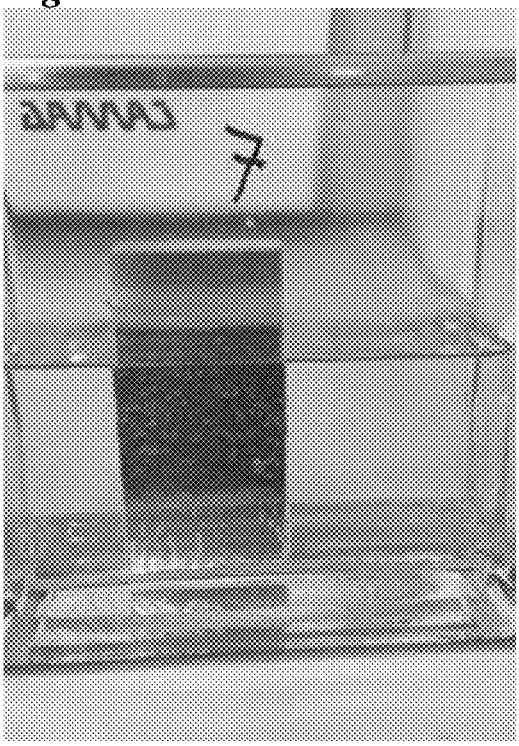
Figure 8B:
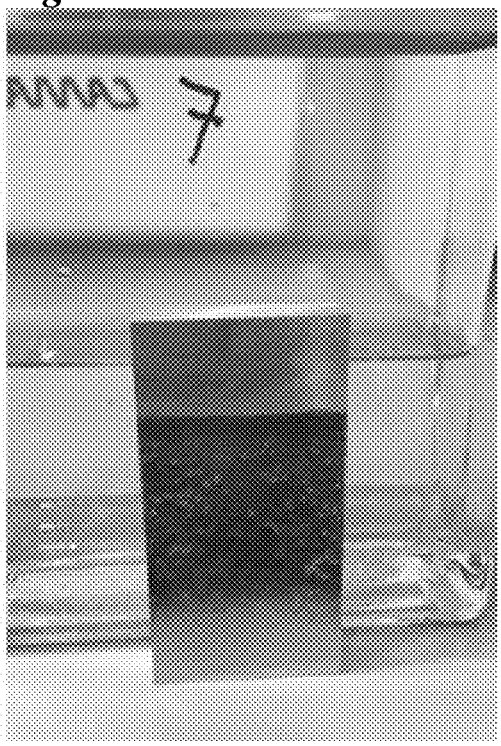

The removal of staining on different aluminium/aluminium alloys was evaluated. The following aluminium/aluminium alloy coupons were tested:

Sample 1: EN AW-1050A
Sample 2: EN AW-2017
Sample 3: EN AW-3003
Sample 4: EN AW-5005A
Sample 5: EN AW-6060
Sample 6: EN AW-7075
Sample 7: EN AW-1050A, thick part The aluminium/aluminium alloy coupons (samples 1-7) were stained by partially submerging them for 1 hour in a NaOH solution in demineralized water at pH 11. The treated parts of the aluminium/aluminium coupons were completely stained and showed very dark discolouration (see FIGS. 5*a-b* [samples 1 and 2], FIGS. 6*a-b* [samples 3 and 4], FIGS. 7*a-b* [samples 5 and 6] and FIGS. 8*a-b* [sample 7]) with the exception of samples 2 and 6, which showed only little staining on the surface of the aluminium/aluminium coupon. The inventors believe that this can be attributed to the thicker aluminium oxide layer present on the surface of these aluminium/aluminium alloy coupons. This thick aluminium oxide layer is more stable and therefore more resistant to staining caused by alkaline media.

Figure 5C:
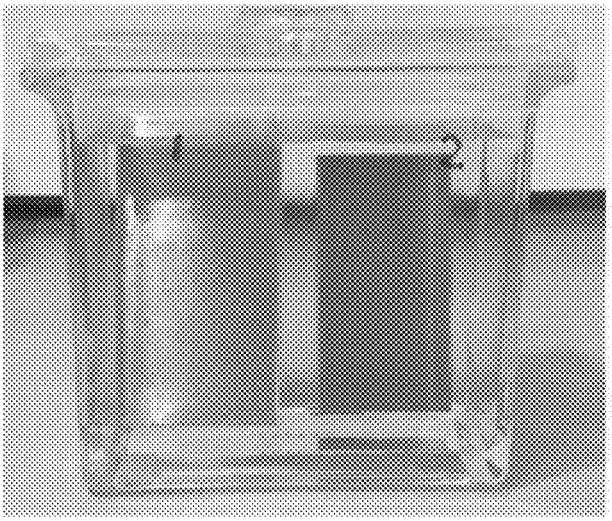
Figure 5D:
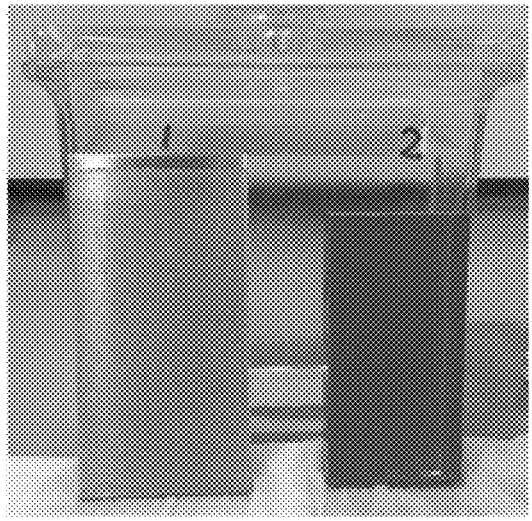
Figure 6C:
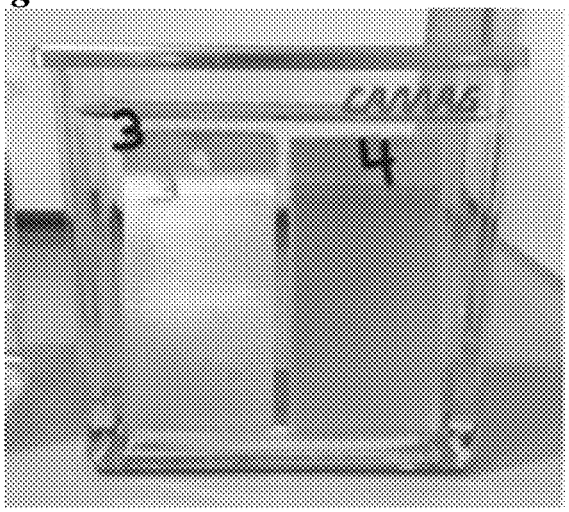
Figure 6D:
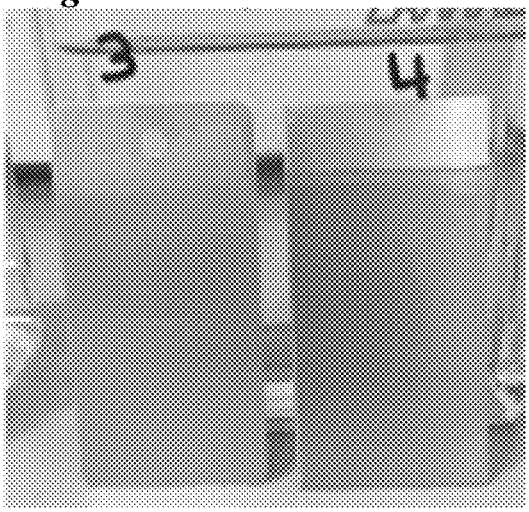
Figure 7C:
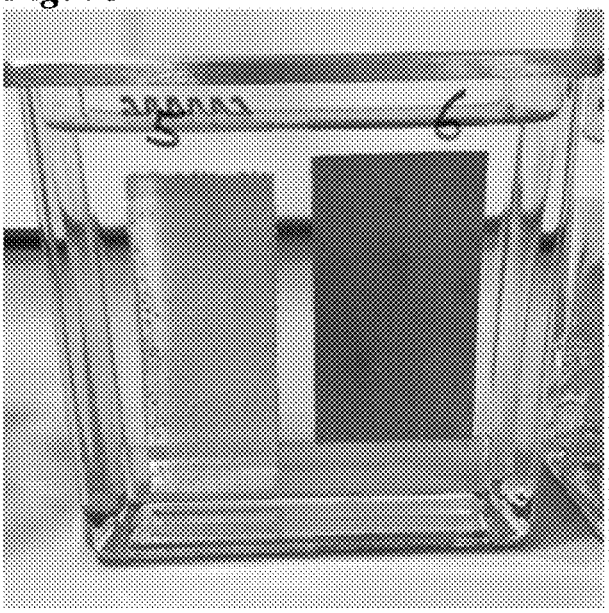
Figure 7D:
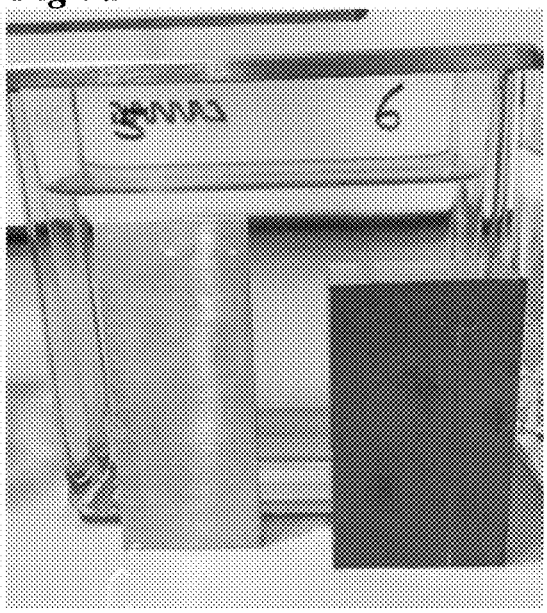
Figure 8C:
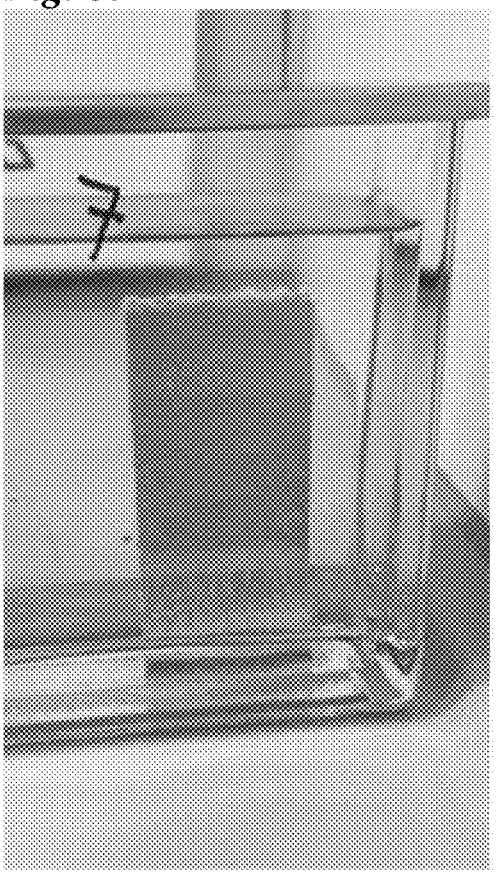
Figure 8D:
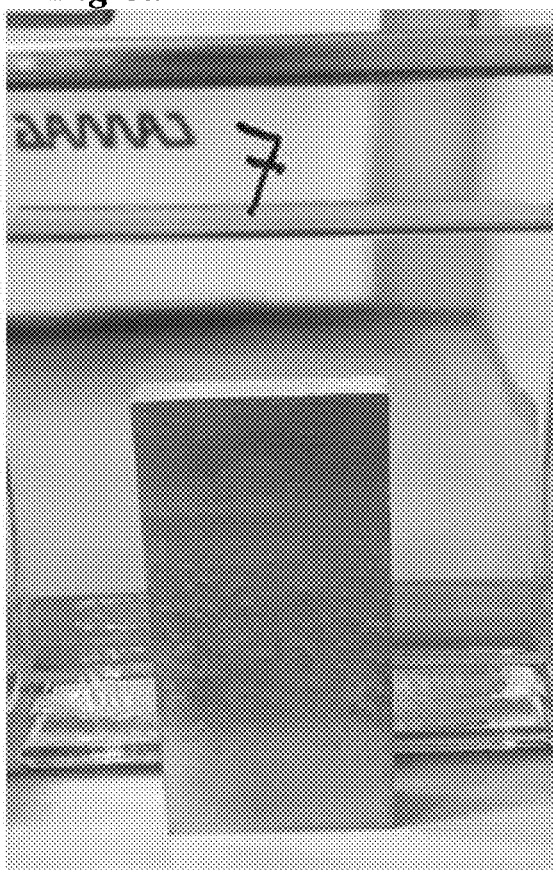

The stained aluminium/aluminium alloy coupons (samples 1-7) were subsequently put in an aqueous treatment liquid comprising 5000 ppm sodium galactarate, based on the total weight of the aqueous treatment liquid, at pH 10.6. The aluminium/aluminium alloy coupons submerged in the aqueous treatment liquid with 5000 ppm sodium galactarate showed no or reduced aluminium staining and discolouration after about 4 hours contacting time. For samples 2 and 6 this effect is less clear but nevertheless present (see FIGS. 5*c-d* [samples 1 and 2], FIGS. 6*c-d* [samples 3 and 4], FIGS. 7*c-d* [samples 5 and 6] and FIGS. 8*c-d* [sample 7]).

The results are described in Table 4. Hence, the removal of aluminium staining/discolouration can be applied on a large variety of industrially applicable aluminium/aluminium alloys.

TABLE 4

| Aluminium (alloy) coupon | Result of the coupon after 1 hour in a NaOH solution in demineralized water at pH 11 | Result after about 4 hours in an aqueous treatment solution comprising 5000 ppm sodium galactarate at pH 10.6 |
|---|---|---|
| EN AW-1050A (sample 1) | very dark discolouration | complete removal of the aluminium staining |
| EN AW-2017 (sample 2) | little discolouration | substantial removal of the aluminium staining |
| EN AW-3003 (sample 3) | dark discolouration | complete removal of the aluminium staining |
| EN AW-5005A (sample 4) | dark discolouration | substantial removal of the aluminium staining |
| EN AW-6060 (sample 5) | dark discolouration | complete removal of the aluminium staining |
| EN AW-7075 (sample 6) | little discolouration | substantial removal of the aluminium staining |
| EN AW-1050A, thick part (sample 7) | very dark discolouration | complete removal of the aluminium staining |

Example 3b

The removal of aluminium staining was evaluated for aluminium and different aluminium alloys, which were first pre-treated with sandpaper to remove any protective oxide layer. The following aluminium coupons were tested:

Sample 1. EN AW-1050A
Sample 2. EN AW-2017
Sample 3. EN AW-5005A
Sample 4. EN AW-6060
Sample 5. EN AW-7075

Figure 9A:
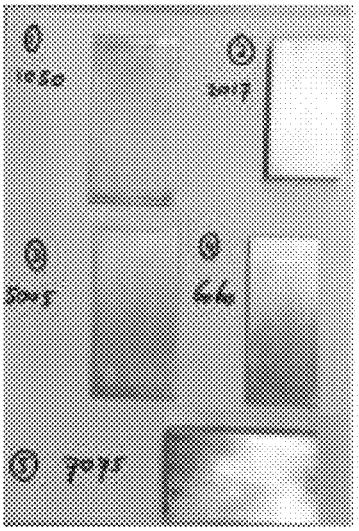
FIG. 9 depicts the removal of staining on aluminium/aluminium alloy coupons with an aqueous solution of 10000 ppm sodium galactarate at pH 10.9 after treatment of the aluminium coupons with sandpaper and treatment with a NaOH solution in demineralized water at pH 11.
Figure 9B:
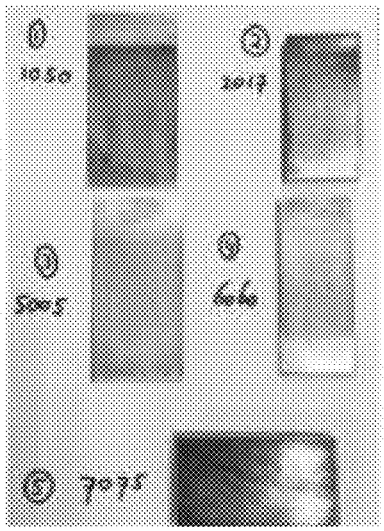

The aluminium/aluminium alloy coupons (samples 1-5) were first treated with a sandpaper to remove any oxide layer (see FIG. 9*a*), followed by partially submerging the coupons for 2 hours in a NaOH solution in demineralized water at pH 11. The treated parts of the aluminium/aluminium alloy coupons were completely stained and showed dark discolouration (see FIG. 9*b*).

Figure 9C:
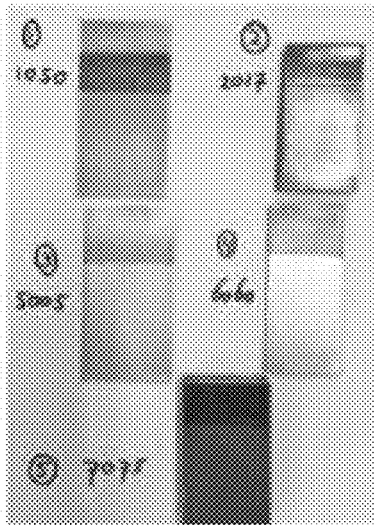

The partially stained aluminium/aluminium alloy coupons (samples 1-5) were subsequently put in an aqueous treatment solution comprising 10000 ppm sodium galactarate, based on the total weight of the aqueous treatment liquid at pH 10.9 for 1.5 hours. All aluminium/aluminium alloy coupons submerged in the aqueous treatment liquid with 10000 ppm sodium galactarate showed complete removal of the aluminium staining (see FIG. 9*c*) with the exception of sample 5, which still showed some discolouration.

Hence, upon removal of the protective oxide layer, the aluminium/aluminium alloys are prone to metal staining caused by alkaline media, which metal staining can be subsequently reduced or even removed by applying an aqueous treatment liquid according to the invention. Hence, Example 3 confirms that removal of the aluminium staining/discolouration can be realized on a large variety of industrially applicable aluminium/aluminium alloys. The results are described in Table 5.

TABLE 5

| Aluminium (alloy) coupon | Result of the coupon after treatment with sandpaper followed by 1 hour in a NaOH solution in demineralized water at pH 11 | Result of the stained coupon after 1.5 hour in an aqueous treatment solution comprising 10000 ppm sodium galactarate at pH 10.9 |
|---|---|---|
| EN AW-1050A (sample 1) | very dark discolouration | complete removal of the aluminium staining |
| EN AW-2017 (sample 2) | very dark discolouration | considerable removal of the aluminium staining |
| EN AW-5005A (sample 3) | dark discolouration | complete removal of the aluminium staining |
| EN AW-6060 (sample 4) | dark discolouration | complete removal of the aluminium staining |
| EN AW-7075 (sample 5) | very dark discolouration | partial removal of the aluminium staining |

Example 4

The effect of the pH of the aqueous treatment liquid on the removal of aluminium staining was evaluated.

Figure 10:
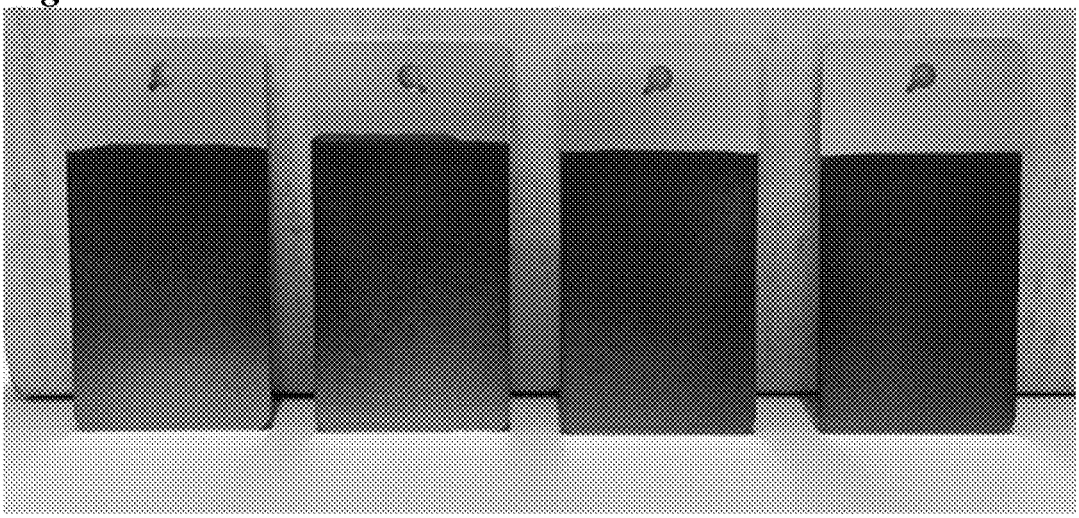
FIG. 10 depicts four partially stained aluminium coupons obtained after treatment of 2 hours with a NaOH solution in demineralized water at pH 11.

Four identical aluminium coupons (Q-panel 3003 H14) were stained by partially submerging them for 2 hours in a NaOH solution in demineralized water at pH 11. The treated parts of the aluminium coupons were completely stained and showed very dark discolouration (see FIG. 10).

The four stained aluminium coupons were subsequently put in four different aqueous treatment liquids:

i) the first coupon in deionized water as a reference;

ii) the second coupon in an aqueous treatment liquid comprising 5000 ppm galactaric acid, based on the total weight of the aqueous treatment liquid, in demineralized water, wherein the pH of the aqueous treatment liquid was adjusted to pH 6 by adding an aqueous solution of 2M NaOH;

iii) the third coupon in an aqueous treatment liquid comprising 5000 ppm galactaric acid, based on the total weight of the aqueous treatment liquid, in demineralized water, wherein the pH of the aqueous treatment liquid was adjusted to pH 8 by adding a aqueous solution of 2M NaOH; and iv) the fourth coupon in an aqueous treatment liquid comprising 5000 ppm galactaric acid, based on the total weight of the aqueous treatment liquid, in demineralized water, wherein the pH of the aqueous treatment solution was adjusted to pH 10 by adding a aqueous solution of 2M NaOH.

The results after a contacting time of about 20 hours are depicted in FIG. 11. The results after a contacting time of about 45 hours are depicted in FIG. 12.

Figure 11A:
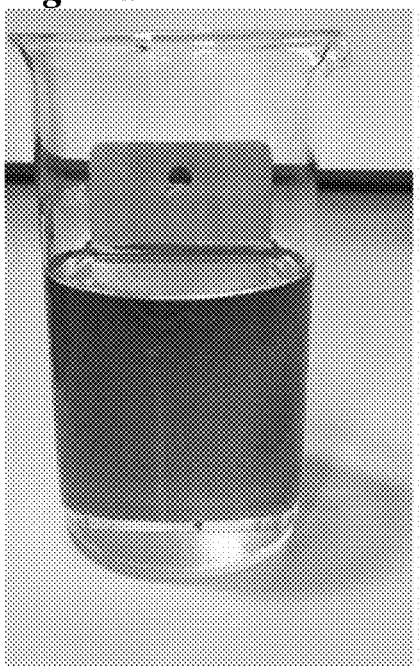
FIG. 11 depicts the removal of the staining on the coupons of FIG. 10 with an aqueous treatment liquid of 5000 ppm sodium galactarate at pH 6, pH 8 or at pH 10 after 20 hours.
Figure 11B:
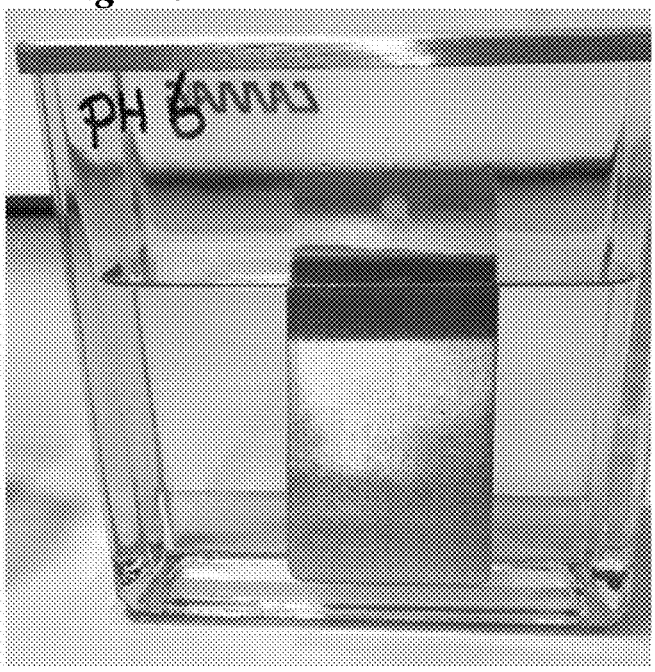
Figure 11C:
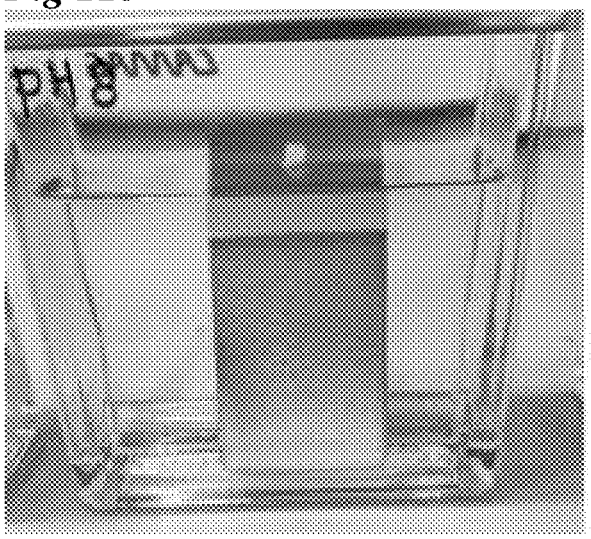
Figure 11D:
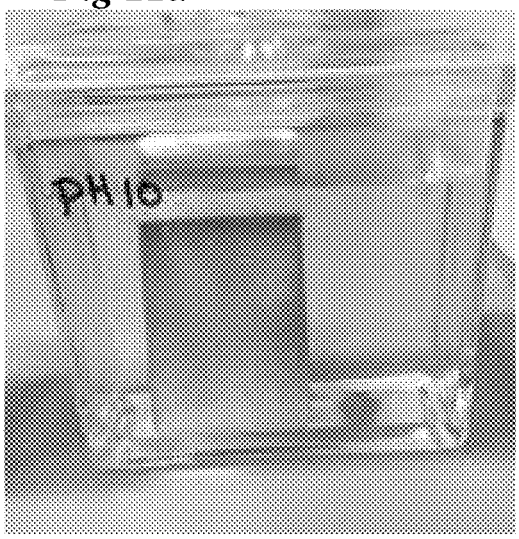
Figure 12A:
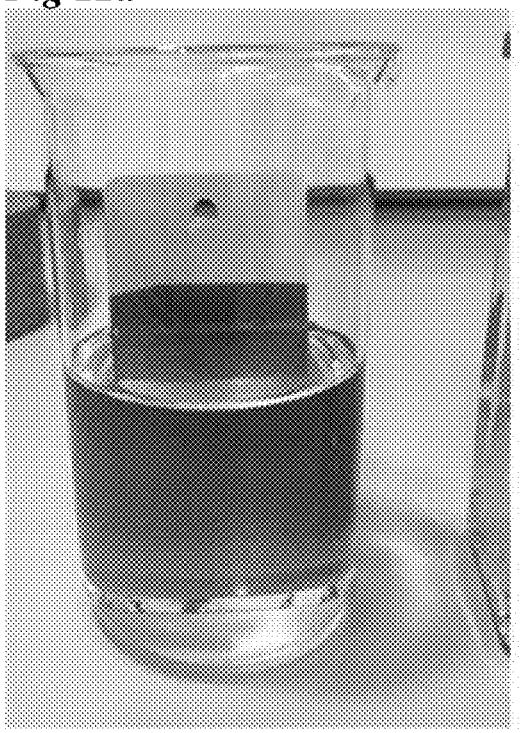
FIG. 12 depicts the removal of the staining on the coupons of FIG. 10 with an aqueous treatment liquid of 5000 ppm sodium galactarate at pH 6, pH 8 or at pH 10 after 45 hours.
Figure 12B:
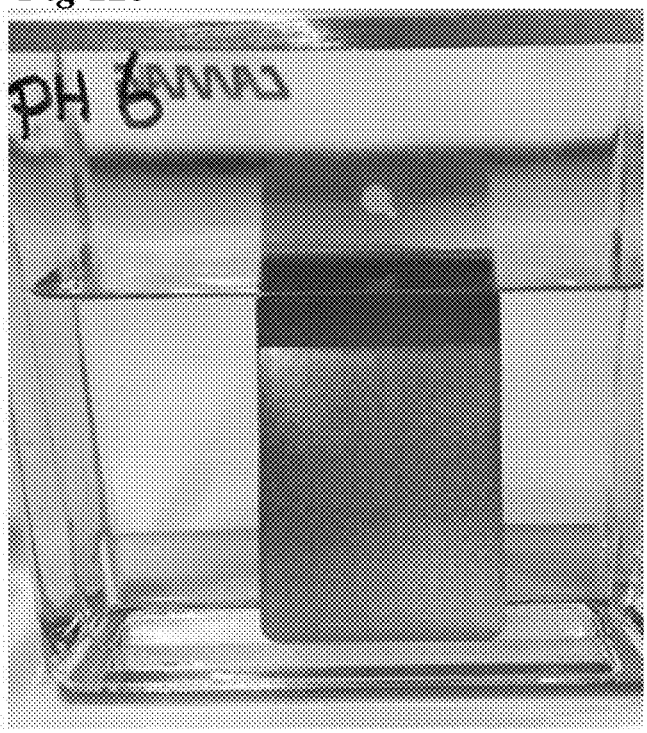
Figure 12C:
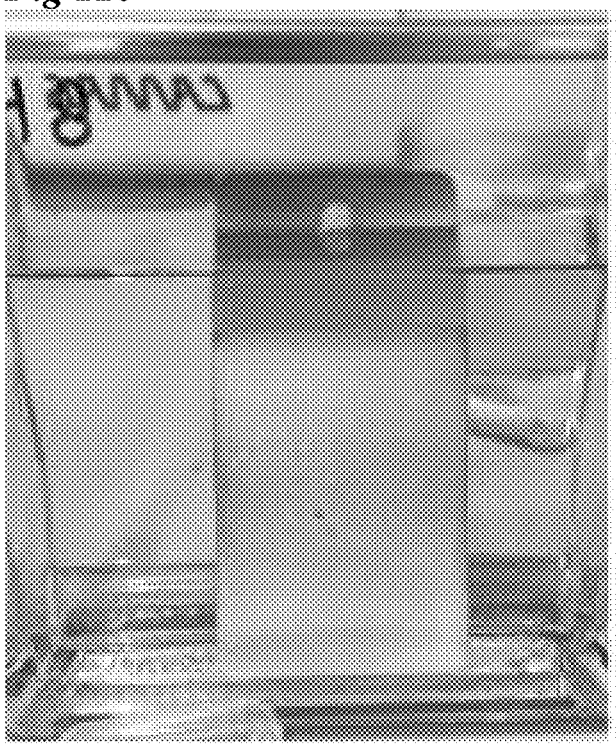
Figure 12D:
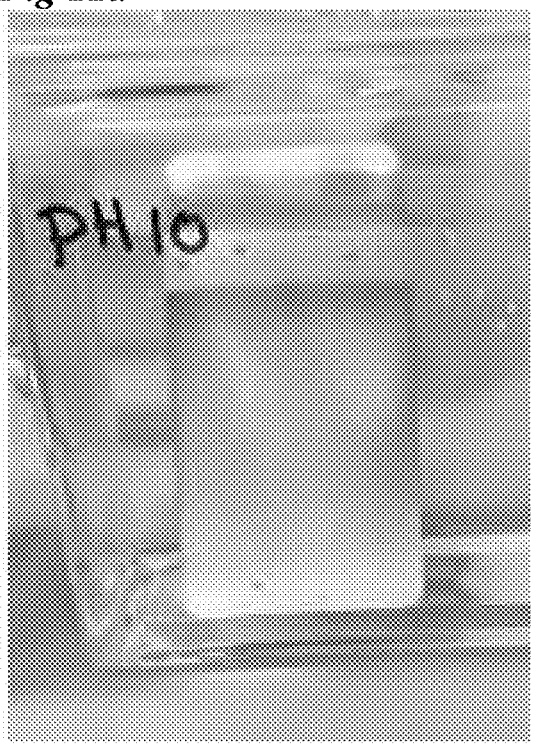

The first aluminium coupon submerged in deionized water showed no destaining after 20 and 45 hours (see FIGS. 11*a* and 12*a*). The second aluminium coupon submerged in the aqueous solution with 5000 ppm sodium galactarate at pH 6 showed only little decolourization/destaining after 20 and 45 hours (see FIG. 11*b* and FIG. 12*b*) as compared to the first aluminium coupon. The third aluminium coupon submerged in the aqueous solution with 5000 ppm sodium galactarate at pH 8 showed partial decolourization/destaining after being submerged in the solution for 20 hours (see FIG. 11*c*) and substantial decolourization/destaining after 45 hours (see FIG. 12*c*). The fourth aluminium coupon submerged in the aqueous solution with 5000 ppm sodium galactarate at pH 10 showed substantial removal of staining after being submerged in the solution for 20 hours (see FIG. 11*d*). This aluminium coupon showed complete decolourization/destaining after being submerged in the solution for 45 hours (see FIG. 12*d*).

Hence, the removal of aluminium staining/discolouration can be accelerated by increasing the pH of the aqueous treatment liquid. Furthermore, the alkaline aqueous treatment liquids comprising sodium galactarate do not form stains on the surface of the aluminium coupons. The results are described in Table 6.

TABLE 6

| Solution | Result after 20 hours | Result after 40 hours |
|---|---|---|
| deionized water | very dark discolouration | very dark discolouration |
| 5000 ppm sodium galactarate in demineralized water at pH 6 | dark discolouration | dark discolouration |
| 5000 ppm sodium galactarate in demineralized water at pH 8 | partial removal of the staining | substantial removal of the staining |
| 5000 ppm sodium galactarate in demineralized water at pH 10 | substantial removal of the staining | complete removal of the staining |

Example 5

The weight loss of aluminium coupons as a result of (i) submerging them for 2 hours in a NaOH solution in demineralized water at pH 11 and (ii) subsequent destaining of the aluminium coupons with an aqueous treatment liquid comprising 5000 ppm sodium galactarate at pH 10.6 was determined.

Four identical aluminium coupons (Q-panel 3003 H14) were first weighed in duplo with a Mettler Toledo analytical balance and then stained by partially submerging them for 2 hours in a NaOH solution in demineralized water at pH 11. The treated parts of the aluminium coupons were completely stained and showed very dark discolouration. The stained aluminium coupons were dried and weighed again in duplo with the balance. The stained aluminium coupons showed a weight loss between 1 and 3 mg (see Table 7).

The four partially stained aluminium coupons were subsequently put in an aqueous treatment liquid comprising 5000 ppm sodium galactarate, based on the total weight of the aqueous treatment liquid, in demineralized water at pH 10.6 for 3 h. All aluminium coupons submerged in the aqueous treatment liquid with 5000 ppm sodium galactarate showed no aluminium stains and no discolouration after 1 hour. The destained aluminium coupons were dried and weighed again in duplo with a balance. The destained aluminium coupons showed a weight loss between 2 and 5 mg as compared to the stained aluminium coupons (see Table 7). This weight loss was confirmed by ICP analysis.

Hence, the removal of aluminium staining/discolouration results in a weight loss of about 0.06 wt. % or less.

TABLE 7

| Coupon | Weight start (duplo) [g] | | Weight after NaOH treatment, pH 11 (duplo) [g] | | Weight after decolourization (duplo) [g] | |
|---|---|---|---|---|---|---|
| 1 | 8.834 | 8.835 | 8.832 | 8.833 | 8.830 | 8.830 |
| 2 | 8.833 | 8.834 | 8.831 | 8.831 | 8.829 | 8.829 |

TABLE 7-continued

| Coupon | Weight start (duplo) [g] | | Weight after NaOH treatment, pH 11 (duplo) [g] | | Weight after decolourization (duplo) [g] | |
|---|---|---|---|---|---|---|
| 3 | 8.832 | 8.832 | 8.831 | 8.830 | 8.828 | 8.827 |
| 4 | 8.844 | 8.845 | 8.844 | 8.843 | 8.840 | 8.839 |

Example 6

The effect of stirring the aqueous treatment liquid during contacting the aluminium with the aqueous treatment liquid was evaluated.

Three identical aluminium coupons (Q-panel 3003 H14) were stained by partially submerging them for 1 hour in a NaOH solution in demineralized water at pH 11. The treated parts of the aluminium coupons were completely stained and showed very dark discolouration.

The second and third stained aluminium coupons were subsequently put in different aqueous treatment liquids:

i) the second coupon in an aqueous treatment liquid comprising 10000 ppm sodium galactarate, based on the total weight of the aqueous treatment liquid, at pH 10.9, wherein the aqueous treatment liquid was stirred with a magnetic stirrer at 250-300 rpm for 45 minutes; and ii) the third coupon in an aqueous treatment solution comprising 10000 ppm sodium galactarate, based on the total weight of the aqueous treatment liquid, at pH 10.9, for 45 minutes.

Figure 13:
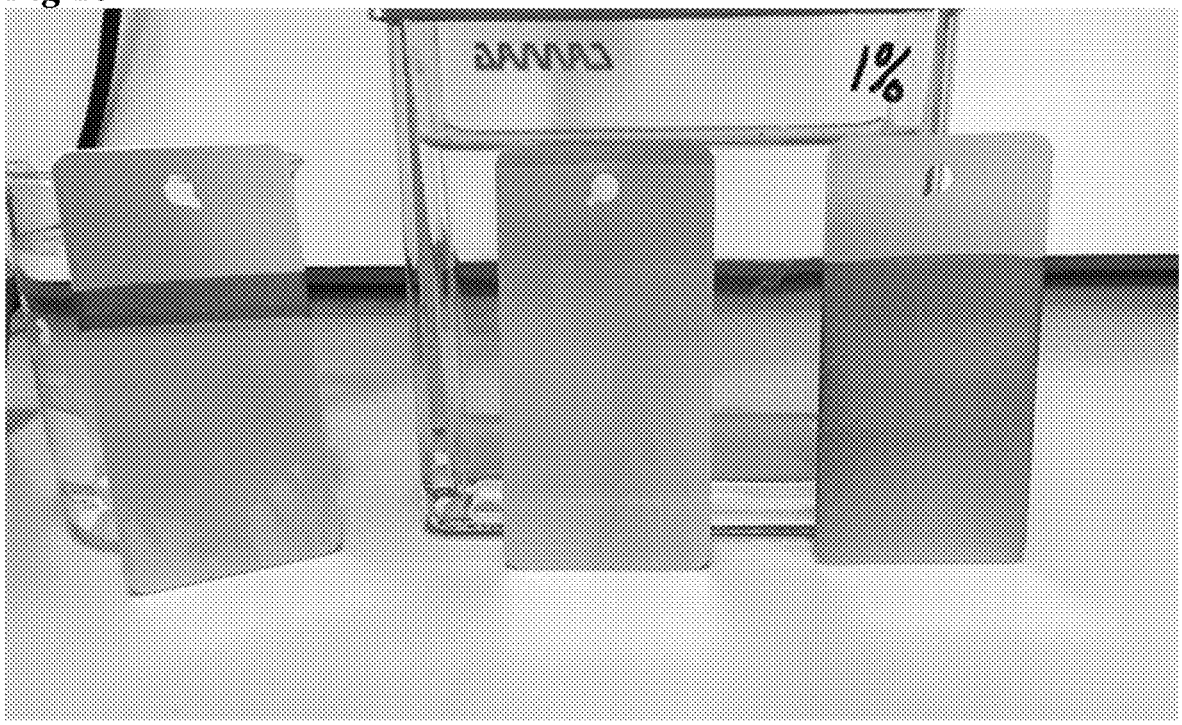
FIG. 13 depicts the effect of stirring on the removal of the staining on the coupons after treatment with a NaOH solution in demineralized water at pH 11 for 1 hour.

The right-hand coupon in FIG. 13 is the first coupon after staining for 1 hour in a NaOH solution in demineralized water at pH 11. The second aluminium coupon was fully destained/decolourized after 15 min and thus also after 45 minutes (see FIG. 13, left-hand coupon). The third aluminium coupon showed complete removal of the aluminium staining after 45 min (see FIG. 13, middle coupon).

Hence, the removal of aluminium staining/discolouration can be accelerated by increasing the concentration of the sodium galactarate (compare with Example 2). Moreover, the removal of aluminium staining/discolouration can be accelerated by stirring the aqueous treatment liquid comprising sodium galactarate. These results are also described in Table 8.

TABLE 8

| Solution | Result after 15 min | Result after 45 min |
|---|---|---|
| An aqueous solution of 10000 ppm sodium galactarate under stirring at pH 10.9 | complete removal of staining/ discolouration | complete removal of staining/ discolouration |
| An aqueous solution of 10000 ppm sodium galactarate without stirring at pH 10.9 | still some staining/ discolouration | complete removal of the staining/ discolouration |

Example 7

The removal of aluminium staining was evaluated at different concentrations of ammonium galactarate.

Two identical aluminium coupons (Q-panel 3003 H14) were first stained by partially submerging them for 1 hour in a NaOH solution in demineralized water at pH 11. The treated parts of the aluminium coupons were completely stained and showed very dark discolouration.

The two stained aluminium coupons were subsequently put in 2 different aqueous treatment liquids: the first coupon in an aqueous treatment solution comprising 10000 ppm ammonium galactarate, based on the total weight of the aqueous treatment liquid, in demineralized water and the second coupon in an aqueous treatment solution comprising 20000 ppm ammonium galactarate, based on the total weight of the aqueous treatment liquid, in demineralized water. The pH of both solutions was about 7.6.

The first aluminium coupon submerged in the aqueous treatment liquid with 10000 ppm ammonium galactarate still showed some staining/discolouration after 21 hours. The second aluminium coupon submerged in the aqueous treatment liquid of 20000 ppm ammonium galactarate also showed still some staining/discolouration after 21 hours. After about 45 hours, both coupons showed less staining/discolouration, but still some stains were left. After about 117 hours, all stains were completely removed from both coupons.

Figure 14:
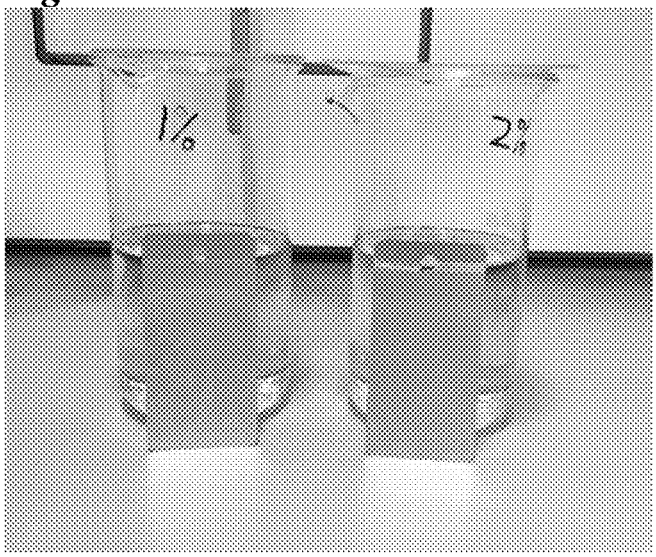
FIG. 14 depicts the removal of the staining using aqueous solutions of 10000 ppm and 20000 ppm ammonium galactarate at pH 7.6.

Hence, the removal of aluminium staining/discolouration can be achieved by applying an aqueous treatment liquid comprising ammonium galactarate. However, applying an aqueous treatment liquid with a higher concentration of ammonium galactarate at pH 7.6 did not accelerate the removal of stains. The final results are described in Table 9 below and in FIG. 14 (result after 117 hours, left-hand side 10000 ppm ammonium galactarate, right-hand side 20000 ppm ammonium galactarate).

TABLE 9

| Solution | Result after 21 hours | Result after 45 hours | Result after 117 hours |
|---|---|---|---|
| 10000 ppm ammonium galactarate at pH 7.6 | discolouration/ staining | little staining/ discolouration | complete removal of discolouration/ staining |
| 20000 ppm ammonium galactarate at pH 7.6 | discolouration/ staining | little staining/ discolouration | complete removal of discolouration/ staining |

Example 8a

In another example, the effect of a pretreatment of aluminium coupons with an aqueous solution of sodium galactarate on the prevention of the formation of alkaline metal stains was evaluated.

Three aluminium coupons (Q-panel 3003 H14) were provided. The individual coupons were treated in different ways:

i) the first coupon did not receive any pretreatment;

ii) the second coupon was first stained by submerging the coupon in a NaOH solution in demineralized water at pH 11 for 2 hours (resulting in very dark discolouration), followed by pretreatment with an aqueous solution comprising 10000 ppm sodium galactarate at pH 10.9 for 1 hour (resulting in removal of the staining); and iii) the third coupon was pretreated by submerging it in an aqueous solution comprising 10000 ppm sodium galactarate at pH 10.9 for 1 hour.

Figure 15:
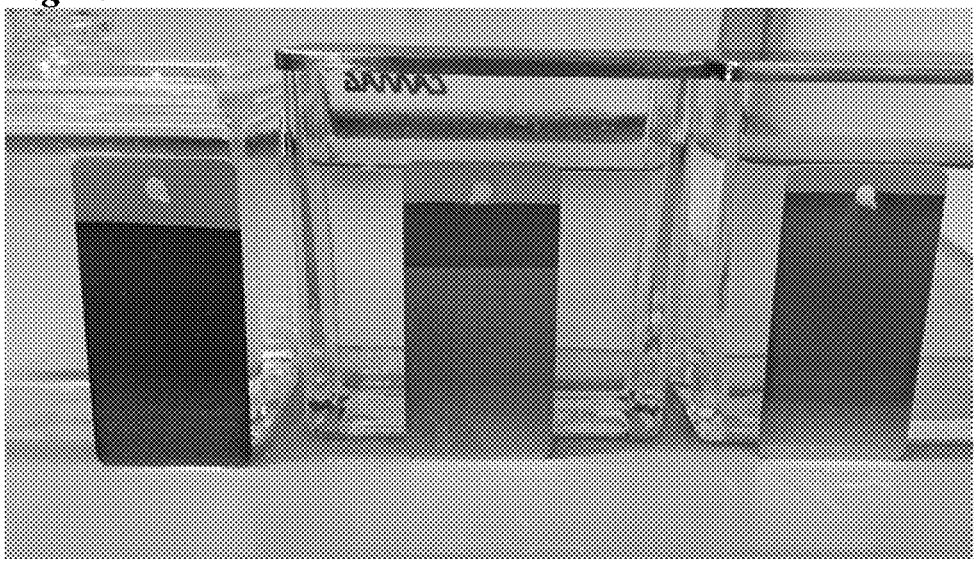
FIGS. 15 and 16 depict the effect of a pretreatment of the coupons with an aqueous solution of 10000 ppm sodium galactarate at pH 10.9 on subsequent staining in a NaOH solution in demineralized water at pH 11.

The three coupons were subsequently partially submerged in a NaOH solution in demineralized water at pH 11 for 3 hours. As a result, the first coupon (not pretreated) was completely stained and showed a very dark discolouration. The second coupon showed only very limited staining or discolouration on the part pretreated with the aqueous solution comprising 10000 ppm sodium galactarate. The third coupon was also stained, but showed less staining as compared to the first coupon. The final results are described in Table 10 and are shown in FIG. 15 (left coupon=1$^{st}$ coupon, middle coupon=2$^{nd}$ coupon and right coupon=3$^{rd}$ coupon).

Hence, the inventors have surprisingly found that by removal of the metal stains on an aluminium coupon with an aqueous solution of sodium galactarate, the resulting aluminium coupon is more resistant to subsequent staining with a NaOH solution in demineralized water at pH 11. It is believed that the sodium galactarate forms a protective layer on the aluminium surface. The difference between the results obtained with the second and third coupons is believed to be due to partial oxidation of the aluminium layer. It is believed that treatment with a NaOH solution in demineralized water at pH 11 followed by treatment with an aqueous solution of sodium galactarate (coupon 2) results in a protective layer coupled to a non-oxidized aluminium surface and that treatment with only an aqueous solution of sodium galactarate on a partially oxidized aluminium surface (coupon 3) results in a protective layer with somewhat diminished protective properties.

TABLE 10

| Pretreatment | Results after treatment with a NaOH solution (3 hours) |
|---|---|
| 1$^{st}$ coupon: no pretreatment | very dark discolouration |
| 2$^{nd}$ coupon (pretreated): stained by a NaOH solution at pH 11, followed by destaining with 10000 ppm sodium galactarate at pH 10.9 for 1 hour | very limited staining/ discolouration |
| 3$^{rd}$ coupon (pretreated): submerged in 10000 ppm sodium galactarate at pH 10.9 for 1 hour | limited discolouration |

Example 8b

In another example, the effect of a pretreatment of aluminium coupons with sandpaper to remove a thin aluminium oxide layer and an aqueous solution of sodium galactarate on the prevention of the formation of metal stains was evaluated.

Five aluminium coupons (Q-panel 3003 H14) were provided. The individual coupons were treated in different ways:

i) the first coupon did not receive any pretreatment;

ii) the second coupon was first stained in a NaOH solution in demineralized water at pH 11 for 2 hours (resulting in very dark discolouration), followed by pretreatment with an aqueous solution comprising 10000 ppm sodium galactarate at pH 10.9 for 20 hours (resulting in removal of the staining);

iii) the third coupon was pretreated by submerging it in an aqueous solution comprising 10000 ppm sodium galactarate at pH 10.9 for 20 hours;

iv) the fourth coupon was pretreated with sandpaper to remove the aluminium oxide outer layer, followed by pretreatment by submerging it in an aqueous solution comprising 10000 ppm sodium galactarate at pH 10.9 for 20 hours; and v) the fifth coupon was pretreated with sandpaper to remove the aluminium oxide outer layer, followed by pretreatment by submerging it in an aqueous solution comprising 10000 ppm sodium galactarate at pH 10.9 for 1 hour.

Figure 16:
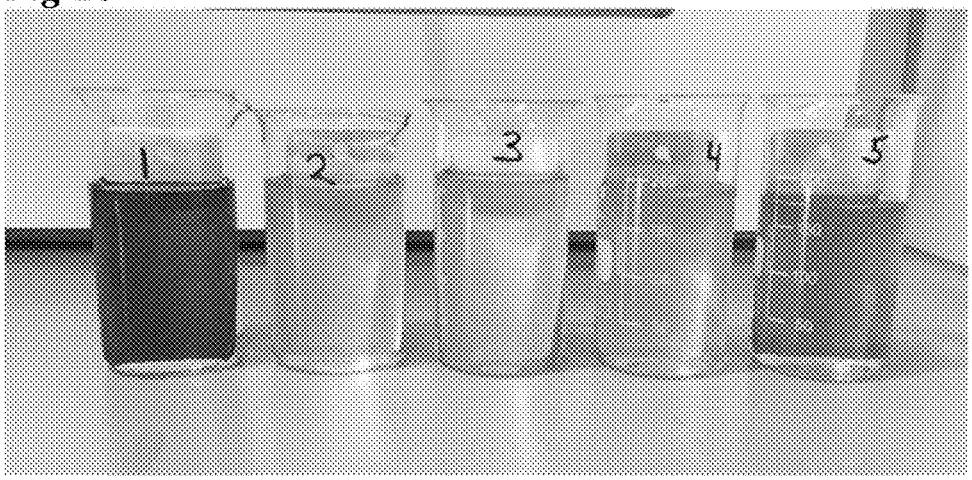

The five coupons were subsequently partially submerged in a NaOH solution in demineralized water at pH 11 for 3 hours. As a result, the first coupon (not pretreated) was completely stained and showed a very dark discolouration. The second, third and fourth coupon showed no staining/discolouration. The fifth coupon showed some staining and a little discolouration. The final results are presented in Table 11 and in FIG. 16 (1$^{st}$ to 5$^{th}$ coupon from left to right).

Hence, the inventors have found that by increasing the contacting time of the pretreatment with the aqueous solution of sodium galactarate, the resistance to subsequent staining with a NaOH solution in demineralized water at pH 11 is increased. A comparison with the results obtained in Example 8a shows that removal of the aluminium oxide layer before pretreatment with the aqueous solution of sodium galactarate has a positive effect on the resistance to subsequent staining with a NaOH solution in demineralized water at pH 11. However, this effect is much less pronounced than the effect of increasing the contacting time of the pretreatment with the aqueous solution of sodium galactarate.

TABLE 11

| Pretreatment | Results after treatment with a NaOH solution (3 hours) |
|---|---|
| 1$^{st}$ coupon: no pretreatment | very dark discolouration |
| 2$^{nd}$ coupon (pretreated): stained by a NaOH solution at pH 11, followed by destaining with 10000 ppm sodium galactarate at pH 10.9 for 20 hour | no staining/discolouration |
| 3$^{rd}$ coupon (pretreated): submerged in 10000 ppm sodium galactarate at pH 10.9 for 20 hours | no staining/discolouration |
| 4$^{th}$ coupon (pretreated): treated with sandpaper and then submerged in 10000 ppm sodium galactarate at pH 10.9 for 20 hours | no staining/discolouration |
| 5$^{th}$ coupon (pretreated): treated with sandpaper and then submerged in 10000 ppm sodium galactarate at pH 10.9 for 1 hour | little staining/discouloration |

Example 9

In another example (not according to the invention) the removal of aluminium staining was evaluated with an aqueous white vinegar solution (AH schoonmaakazijn, pH=2.8).

Two aluminium coupons (Q-panel 3003 H14) were first stained by partially submerging them for 2 hours in a NaOH solution in demineralized water at pH 11. The treated parts of the aluminium coupons were completely stained and showed very dark discolouration.

Figure 17A:
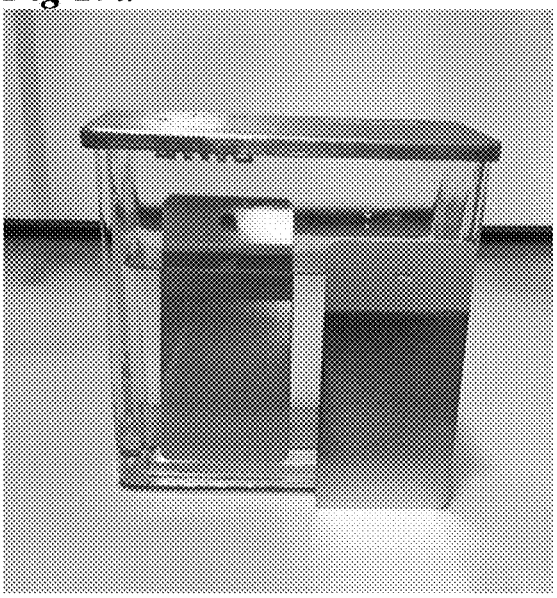
FIG. 17 depicts the effect of a white vinegar solution at pH 2.8 on the removal of staining on an aluminium coupon after 3 hours.
Figure 17B:
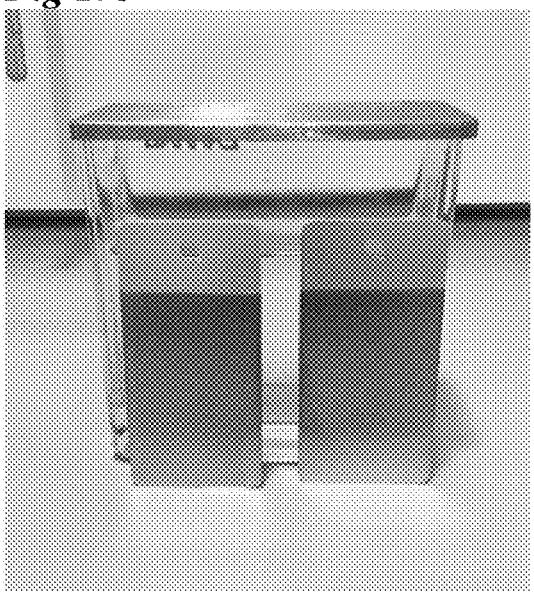

The stained aluminium coupons were then submerged in the commercial white vinegar solution at pH 2.8 for 3 hours. The resulting aluminium coupons showed no destaining and still had a very dark discolouration. The results are described in Table 12 below and are shown in FIG. 17*a* (before applying the aqueous white vinegar solution) and in FIG. 17*b* (after applying the aqueous white vinegar solution).

TABLE 12

| Solution | Result after 3 hours |
|---|---|
| A commercial aqueous white vinegar solution having pH = 2.8 | Very dark discolouration |

Example 10

The following aluminium/aluminium alloy coupons were subjected to staining with a NaOH solution in demineralized water at pH 11 and subsequent treatment with 10000 ppm sodium galactarate at pH 10.9 for 1.5 hours:

Sample 1. EN AW-1050A

Sample 2. EN AW-2017

Figure 18A:
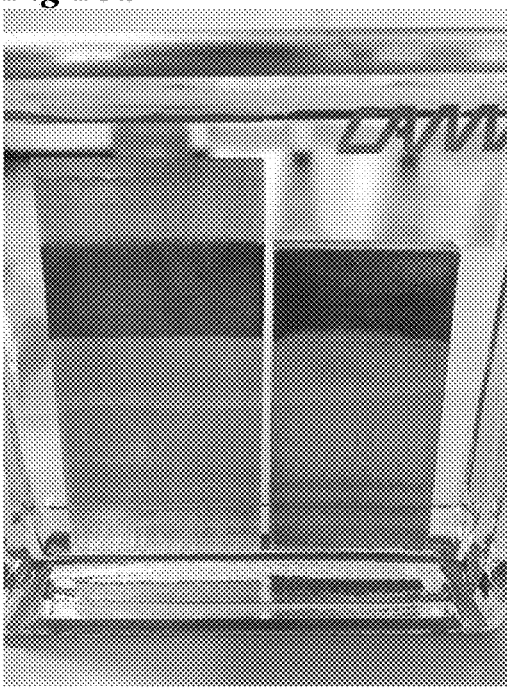
FIG. 18 depicts self-healing properties of aluminium/aluminium alloy coupons treated with an aqueous solution of 10000 ppm sodium galactarate at pH 10.9.
Figure 18B:
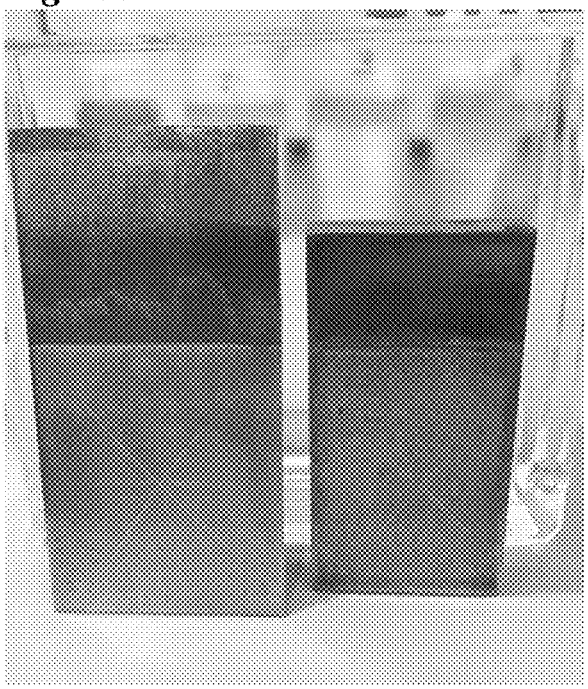

Subsequently, a cross cut was made on the surface of both coupons with a pair of scissors and the resulting coupons were again subjected to a NaOH solution in demineralized water at pH 11. Although some staining was visible on the surfaces of both coupons after two and four hours, the original colour of the coupons in the cross cut was still visible (See FIG. 18*a*, before subjecting the surface with the cross cut to the NaOH solution in demineralized water at pH 11, and FIG. 18*b*, after 4 hours). This indicates that the sodium galactarate layer may have self-healing properties.

The invention claimed is:

1. A method for removing and/or decolourizing metal stains on a surface of a substrate composed of aluminium or aluminium alloy, the method comprising the consecutive steps of:

a) providing the substrate comprising metal stains on the surface, said metal stains having a metal stain surface area;

b) providing an aqueous treatment liquid comprising one or more components selected from the group consisting of galactaric acid and galactarate salts; and c) treating at least part of the surface of the substrate by contacting at least part of the metal stain surface area with the aqueous treatment liquid, wherein the aqueous treatment liquid is free of phosphorus- and/or acrylate-containing compounds and wherein the pH of the aqueous treatment liquid is between 6.5 and 10.9.

2. The method according to claim 1, wherein the metal stains are the result of subjecting the surface of the substrate to an alkaline treatment.

3. The method according to claim 1, further comprising the step of:

d) subjecting at least the treated part of the surface of the substrate obtained in step (c) to a drying operation.

4. The method according to claim 1, wherein step (c) comprises immersing the at least part of the metal stain surface area in the aqueous treatment liquid.

5. The method according to claim 1, wherein step (c) comprises contacting the whole metal stain surface area with the aqueous treatment liquid.

6. The method according to claim 1, wherein the aqueous treatment liquid comprises more than 100 ppm, based on the total weight of the aqueous treatment liquid, of the one or more components selected from the group consisting of galactaric acid and galactarate salts.

7. The method according to claim 6, wherein the aqueous treatment liquid comprises, based on the total weight of the aqueous treatment liquid, less than 25000 ppm of the one or more components selected from the group consisting of galactaric acid and galactarate salts.

8. The method according to claim 1, wherein the aqueous treatment liquid comprises a galactarate salt selected from the group consisting of ammonium galactarate, mono ethanolamine galactarate, di-ethanolamine galactarate, tri-ethanolamine galactarate, mono-isopropanolamine galactarate, sodium galactarate, potassium galactarate, and combinations thereof.

9. The method according to claim 1, wherein the pH of the aqueous treatment liquid is between 7 and 10.7.

10. The method according to claim 1, wherein step (c) is performed at a temperature between 10 and 30° C.

11. The method according to claim 1, wherein the aqueous treatment liquid comprises sodium galactarate and the concentration of sodium galactarate in the aqueous treatment liquid is:

(i) between 1000 and 3000 ppm, such as about 2000 ppm, based on the total weight of the aqueous treatment liquid, wherein the time period of contacting the at least part of the metal stain surface area with the aqueous treatment liquid in step (c) is between 2 hours and 6 days;

(ii) between 4000 and 6000 ppm, such as about 5000 ppm, based on the total weight of the aqueous treatment liquid, wherein the time period of contacting the at least part of the metal stain surface area with the aqueous treatment liquid in step (c) is between 1 hour and 6 days;

(iii) between 6000 and 10000 ppm, such as about 8000 ppm based on the total weight of the aqueous treatment liquid, wherein the time period of contacting the at least part of the metal stain surface area with the aqueous treatment liquid in step (c) is between 40 minutes and 6 days; or (iv) between 8000 and 12000 ppm, such as about 10000 ppm, based on the total weight of the aqueous treatment liquid, wherein the time period of contacting the at least part of the metal stain surface area with the aqueous treatment liquid in step (c) is between 30 minutes and 6 days.

12. The method according to claim 1, wherein the aqueous treatment liquid comprises ammonium galactarate and the concentration of ammonium galactarate in the aqueous treatment liquid is between 5000 and 25000 ppm, based on the total weight of the aqueous treatment liquid, and wherein the time period of contacting the at least part of the metal stain surface area with the aqueous treatment liquid in step (c) is between 1 and 6 days.

13. The method according to claim 1, wherein the aqueous treatment liquid is selected from the group consisting of aqueous anodising liquids, aqueous metal-rolling liquids, aqueous aluminium cleaning liquids, aqueous lubricant liquids and aqueous pickling liquids.

14. Product obtainable by the method as defined in claim 1.

15. The method according to claim 1, wherein the aqueous treatment liquid does not comprise other acidic components and their salts than said one or more components selected from the group consisting of galactaric acid and galactarate salts.

* * * * *